US012158066B2

(12) United States Patent
Wicks et al.

(10) Patent No.: US 12,158,066 B2
(45) Date of Patent: Dec. 3, 2024

(54) AUTODRILLER CONTEXTUAL SCALING

(71) Applicant: Schlumberger Technology Corporation, Sugar Land, TX (US)

(72) Inventors: Nathaniel Wicks, Somerville, MA (US); Jian Wu, Houston, TX (US); Benjamin Peter Jeffryes, Cambridge (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 219 days.

(21) Appl. No.: 17/085,224

(22) Filed: Oct. 30, 2020

(65) Prior Publication Data

US 2021/0131258 A1 May 6, 2021

Related U.S. Application Data

(60) Provisional application No. 62/928,151, filed on Oct. 30, 2019.

(51) Int. Cl.

| | |
|---|---|
| ***E21B 44/02*** | (2006.01) |
| ***E21B 4/02*** | (2006.01) |
| ***E21B 33/068*** | (2006.01) |
| ***E21B 45/00*** | (2006.01) |

(52) U.S. Cl.

CPC ..... *E21B 44/02* (2013.01); *E21B 4/02* (2013.01); *E21B 33/068* (2013.01); *E21B 45/00* (2013.01)

(58) Field of Classification Search

CPC ..... E21B 44/00; E21B 44/02

See application file for complete search history.

(56) References Cited

U.S. PATENT DOCUMENTS

| | | | | |
|---|---|---|---|---|
| 7,775,297 | B2 | 8/2010 | Hopwood et al. | |
| 10,591,625 | B2 | 3/2020 | Holt | |
| 10,689,967 | B2 | 6/2020 | Jeffryes | |
| 2010/0300753 | A1 | 12/2010 | Hopwood et al. | |
| 2013/0341091 | A1* | 12/2013 | Sugiura | E21B 45/00 175/24 |
| 2015/0167392 | A1* | 6/2015 | Sugiura | E21B 7/04 175/45 |
| 2015/0252664 | A1* | 9/2015 | Astrid | E21B 21/08 700/275 |
| 2016/0138382 | A1* | 5/2016 | Badkoubeh | E21B 44/00 175/24 |
| 2018/0128093 | A1 | 5/2018 | Jeffryes et al. | |
| 2018/0149010 | A1 | 5/2018 | Zheng | |
| 2021/0115779 | A1 | 4/2021 | Hopwood | |

FOREIGN PATENT DOCUMENTS

| | | | |
|---|---|---|---|
| WO | 2017083454 | A1 | 5/2017 |
| WO | 2019050824 | A1 | 3/2019 |

* cited by examiner

*Primary Examiner* — Giovanna Wright
(74) *Attorney, Agent, or Firm* — Kelly McKinney

(57) ABSTRACT

Methods and apparatus pertaining to scaling of the proportional gain and the integral gain in PI controllers of an autodriller based on drilling context. For example, a proportional gain and an integral gain are each determined for utilization by a PI controller of an autodriller controlling operation of equipment to be utilized for a drilling operation to drill a borehole into a subterranean formation. During the drilling operation, the integral gain is updated in real-time utilizing current values of drilling parameters that change with respect to time.

19 Claims, 5 Drawing Sheets

AUTODRILLER CONTEXTUAL SCALING

CROSS-REFERENCE TO RELATED APPLICATIONS

This application claims priority to and the benefit of U.S. Provisional Application No. 62/928,151, titled "Autodriller Contextual Scaling," filed Oct. 30, 2019, the entire disclosure of which is hereby incorporated herein by reference.

BACKGROUND OF THE DISCLOSURE

In the context of an oil/gas drilling rig, an autodriller utilizes inputs (e.g., measured and/or estimated rate of penetration (ROP), weight on bit (WOB), mud motor pressure differential (ΔP), top drive (TD) torque ($T_{TD}$), etc.) to output an ROP command to be sent to a drawworks controller. The autodriller control logic utilizes proportional-integral (PI) controllers of one or more parameters (e.g., ROP, WOB, ΔP, $T_{TD}$) to attempt to increase ROP until reaching a user-defined setpoint and/or limit of one or more of the input parameters. When that limit and/or setpoint is reached, the autodriller adjusts the ROP to achieve the parameter setpoint.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces a method including determining a proportional gain and an integral gain each to be utilized by a PI controller of an autodriller controlling operation of equipment to be utilized for a drilling operation to drill a borehole into a subterranean formation. The method also includes commencing the drilling operation and, during the drilling operation, updating the integral gain in real-time utilizing current values of drilling parameters that change with respect to time.

The present disclosure also introduces an apparatus including a processing system having a processor and a memory storing an executable computer program code that, when executed by the processor, determines a proportional gain and an integral gain each to be utilized by a PI controller of an autodriller controlling operation of equipment to be utilized for a drilling operation to drill a borehole into a subterranean formation. During the drilling operation, the processing system also updates the integral gain in real-time utilizing current values of drilling parameters that change with respect to time.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
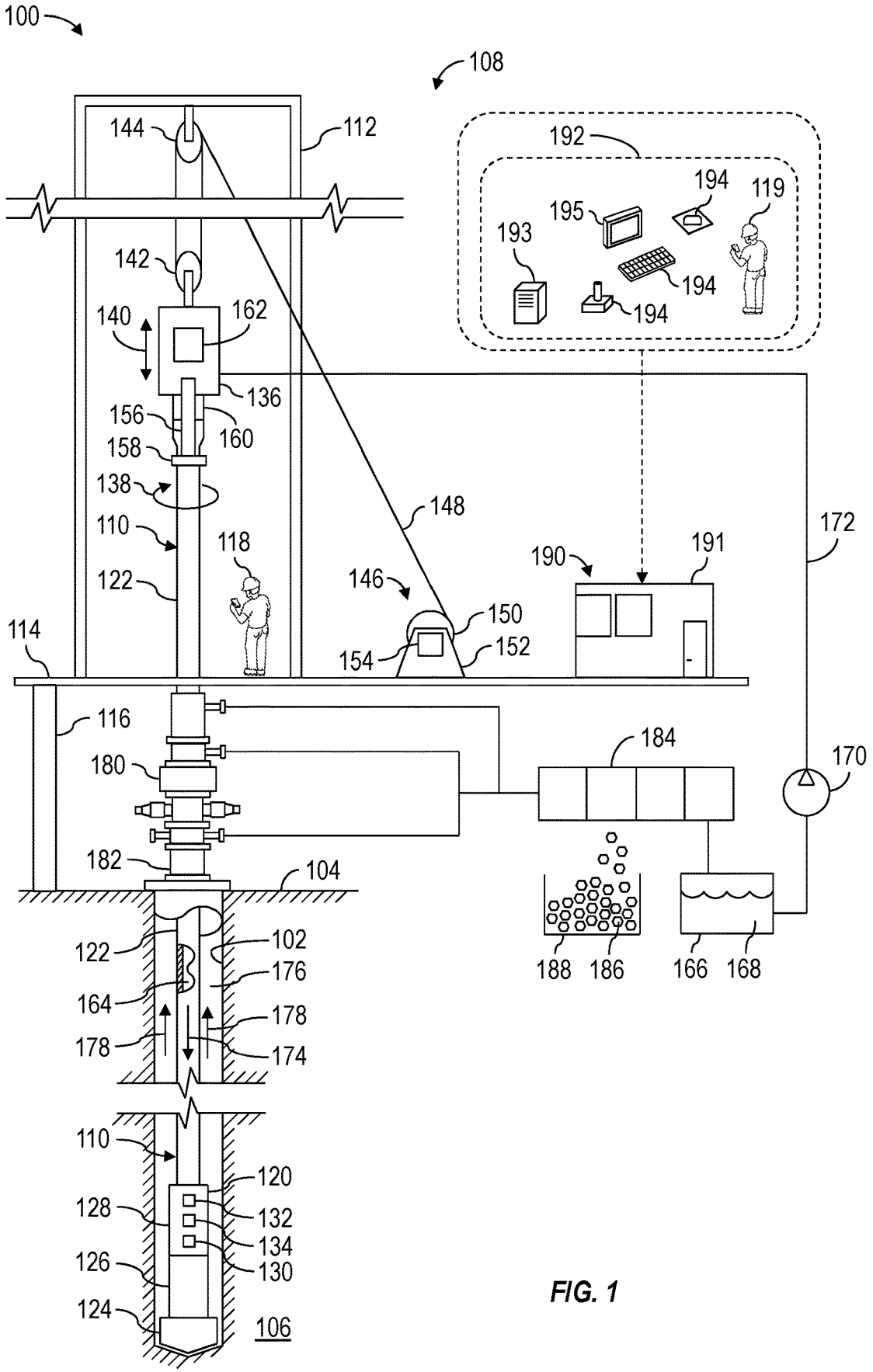
FIG. 1 is a schematic view of at least a portion of an example implementation of apparatus according to one or more aspects of the present disclosure.

It is to be understood that the following disclosure provides many different examples for different features of various implementations. Specific examples of components and arrangements are described below to simplify the present disclosure. However, these are merely examples and are not intended to be limiting. In addition, the present disclosure may repeat reference numerals and/or letters in the various examples. This repetition is for simplicity and clarity and does not in itself dictate a relationship between the various implementations discussed.

FIG. 1 is a schematic view of at least a portion of an example implementation of a well construction system 100 according to one or more aspects of the present disclosure. The well construction system 100 represents an example environment in which one or more aspects of the present disclosure described below may be implemented. The well construction system 100 may be or comprise a drilling rig and associated equipment. Although the well construction system 100 is depicted as an onshore implementation, the aspects described below are also applicable to offshore implementations.

The well construction system 100 is depicted in relation to a wellbore 102 formed by rotary and/or directional drilling from a wellsite surface 104 and extending into a subterranean formation 106. The well construction system 100 comprises well construction equipment, such as surface equipment 108 located at the wellsite surface 104 and a drillstring 110 suspended within the wellbore 102. The surface equipment 108 may include a mast, a derrick, and/or another support structure 112 disposed over a rig floor 114. The drillstring 110 may be suspended within the wellbore 102 from the support structure 112. The support structure 112 and the rig floor 114 are collectively supported over the wellbore 102 by legs and/or other support structures 116. Certain pieces of the surface equipment 108 may be manually operated (e.g., by hand, via a local control panel) by rig personnel 118 (e.g., a roughneck or another human rig operator) located at various portions (e.g., the rig floor 114) of the well construction system 100.

The drillstring 110 may comprise a bottom-hole assembly (BHA) 120 and means 122 for conveying the BHA 120 within the wellbore 102. The conveyance means 122 may comprise drill pipe, heavy-weight drill pipe (HWDP), wired drill pipe (WDP), tough logging condition (TLC) pipe, and/or other means for conveying the BHA 120 within the wellbore 102. A downhole end of the BHA 120 may include or be coupled to a drill bit 124. Rotation of the drill bit 124 and the weight of the drillstring 110 collectively operate to form the wellbore 102. The drill bit 124 may be rotated by a driver at the wellsite surface 104 and/or via a downhole mud motor 126 operatively connected with the drill bit 124. The BHA 120 may also include one or more downhole tools 128 above and/or below the mud motor 126.

One or more of the downhole tools 128 may be or comprise a measurement-while-drilling (MWD) or logging-while-drilling (LWD) tool comprising downhole sensors 130 operable for the acquisition of measurement data pertaining to the BHA 120, the wellbore 102, and/or the formation 106. The downhole sensors 130 may comprise an inclination sensor, a rotational position sensor, and/or a rotational speed sensor, which may include one or more accelerometers, magnetometers, gyroscopic sensors (e.g., micro-electro-mechanical system (MEMS) gyros), and/or other sensors for determining the orientation, position, and/or speed of one or more portions of the BHA 120 (e.g., the drill bit 124, the downhole tool 128, and/or the mud motor 126) and/or other portions of the drillstring 110 relative to the wellbore 102 and/or the wellsite surface 104. The downhole sensors 130 may comprise a depth correlation tool utilized to determine and/or log position (i.e., depth) of one or more portions of the BHA 120 and/or other portions of the drillstring 110 within the wellbore 102 and/or with respect to the wellsite surface 104.

One or more of the downhole tools 128 and/or other portion(s) of the BHA 120 may also comprise a telemetry device 132 operable to communicate with the surface equipment 108, such as via mud-pulse telemetry, electromagnetic telemetry, and/or other telemetry means. One or more of the downhole tools 128 and/or other portion(s) of the BHA 120 may also comprise a downhole controller 134 operable to receive, process, and/or store data received from the surface equipment 108, the downhole sensors 130, and/or other portions of the BHA 120. The controller 134 may also store executable computer programs (e.g., program code instructions), including for implementing one or more aspects of the operations described herein.

The support structure 112 may support the driver, such as a top drive 136, operable to connect (perhaps indirectly) with an upper end of the drillstring 110, and to impart rotary motion 138 and vertical motion 140 to the drillstring 110, including the drill bit 124. However, another driver, such as a kelly and a rotary table (neither shown), may be utilized in addition to or instead of the top drive 136 to impart the rotary motion 138 to the drillstring 110. The top drive 136 and the connected drillstring 110 may be suspended from the support structure 112 via a hoisting system or equipment, which may include a traveling block 142, a crown block 144, and a drawworks 146 storing a support cable or line 148. The crown block 144 may be connected to or otherwise supported by the support structure 112, and the traveling block 142 may be coupled with and/or otherwise travels with the top drive 136. The drawworks 146 may be mounted on or otherwise supported by the rig floor 114. The crown block 144 and the traveling block 142 comprise pulleys or sheaves around which the support line 148 is reeved to operatively connect the crown block 144, the traveling block 142, and the drawworks 146 (and perhaps an anchor, not shown). The drawworks 146 may, thus, selectively impart tension to the support line 148 to lift and lower the top drive 136, resulting in the vertical motion 140. The drawworks 146 may comprise a drum 150, a base 152, and a prime mover (e.g., an engine or motor) 154 operable to drive the drum 150 to rotate and reel in the support line 148, thereby causing the traveling block 142 and the top drive 136 to move upward. The drawworks 146 may be further operable to reel out the support line 148 via a controlled rotation of the drum 150, thereby causing the traveling block 142 and the top drive 136 to move downward.

The top drive 136 may comprise a grabber, a swivel (neither shown), elevator links 156 terminating with an elevator 158, and a drive shaft 160 operatively connected with a prime mover (e.g., an electric motor) 162 of the top drive 136, such as via a gear box or transmission (not shown). The drive shaft 160 may be selectively coupled with the upper end of the drillstring 110 (perhaps indirectly) and the prime mover 162 may be selectively operated to rotate the drive shaft 160 and the drillstring 110 coupled with the drive shaft 160. Thus, during drilling operations, the top drive 136, in conjunction with operation of the drawworks 146, may advance the drillstring 110 into the formation 106 to form the wellbore 102. The elevator links 156 and the elevator 158 of the top drive 136 may handle tubulars (e.g., joints and/or stands of drillpipe, drill collars, casing, etc.) that are not mechanically coupled to the drive shaft 160. For example, when the drillstring 110 is being tripped into or out of the wellbore 102, the elevator 158 may grasp the tubulars of the drillstring 110 such that the tubulars may be raised and/or lowered via the hoisting equipment mechanically coupled to the top drive 136. The top drive 136 may have a guide system (not shown), such as rollers that track up and down a guide rail on the support structure 112. The guide system may aid in keeping the top drive 136 aligned with the wellbore 102, and in preventing the top drive 136 from rotating during drilling by transferring reactive torque to the support structure 112.

The well construction system 100 may further include a drilling fluid circulation system or equipment operable to circulate fluids between the surface equipment 108 and the drill bit 124 during drilling and other operations. For example, the drilling fluid circulation system may be operable to inject a drilling fluid from the wellsite surface 104 into the wellbore 102 via an internal fluid passage 164 extending longitudinally through the drillstring 110. The drilling fluid circulation system may comprise a pit, a tank, and/or other fluid container 166 holding the drilling fluid 168 (i.e., mud), and one or more pumps 170 operable to move the drilling fluid 168 from the container 166 into the fluid passage 164 of the drillstring 110 via a fluid conduit (e.g., stand pipe) 172 extending from the pump 170 to the top drive 136 and an internal passage extending through the top drive 136 (not shown).

During drilling operations, the drilling fluid may continue to flow downhole through the internal passage 164 of the drillstring 110, as indicated by directional arrow 174. The drilling fluid may exit the BHA 120 via ports in the mud motor 126 and/or the drill bit 124 and then circulate uphole through an annular space 176 of the wellbore 102 defined between an exterior of the drillstring 110 and the sidewall of the wellbore 102, such flow being indicated in FIG. 1 by directional arrows 178. In this manner, the drilling fluid lubricates the drill bit 124 and carries formation cuttings uphole to the wellsite surface 104. The drilling fluid flowing downhole through the internal passage 164 may selectively actuate the mud motor 126 to rotate the drill bit 124 instead of or in addition to the rotation of the drillstring 110 via the top drive 136. Accordingly, rotation of the drill bit 124 caused by the top drive 136 and/or the mud motor 126, in conjunction with the WOB, may advance the drillstring 110 through the formation 106 to form the wellbore 102.

The well construction system 100 may further include fluid control equipment 180 for maintaining well pressure control and for controlling fluid being discharged from the wellbore 102. The fluid control equipment 180 may be mounted on top of a wellhead 182. The drilling fluid flowing uphole 178 toward the wellsite surface 104 may exit the annulus 176 via one or more components of the fluid control equipment 180, such as a bell nipple, a rotating control device (RCD), and/or a ported adapter (e.g., a spool, a cross adapter, a wing valve, etc.). The drilling fluid may then pass through drilling fluid reconditioning equipment 184 to be cleaned and reconditioned before returning to the fluid container 166. The drilling fluid reconditioning equipment 184 may also separate drill cuttings 186 from the drilling fluid into a cuttings container 188.

The surface equipment 108 of the well construction system 100 may also comprise a control center 190 from which various portions of the well construction system 100, such as a drillstring rotation system (e.g., the top drive 136), a hoisting system (e.g., the drawworks 146 and the blocks 142, 144), a drilling fluid circulation system (e.g., the mud pump 170 and the fluid conduit 172), a drilling fluid cleaning and reconditioning system (e.g., the drilling fluid reconditioning equipment 184 and the containers 166, 188), the well control system (e.g., a BOP stack, a choke manifold, and/or other components of the fluid control equipment 180), and the BHA 120, among other examples, may be monitored and controlled. The control center 190 may be located on the rig floor 114 or another location of the well construction system 100, such as the wellsite surface 104.

The control center 190 may comprise a facility 191 (e.g., a room, a cabin, a trailer, a truck or other service vehicle, etc.) containing a control workstation 192, which may be operated by rig personnel 118 (e.g., a driller or other human rig operator(s)) to monitor and control various wellsite equipment and/or portions of the well construction system 100. The control workstation 192 may comprise or be communicatively connected with a surface equipment controller 193 (e.g., a processing device, a computer, etc.), such as may be operable to receive, process, and output information to monitor operations of and provide control to one or more portions of the well construction system 100. For example, the controller 193 may be communicatively connected with the surface equipment 108 and downhole equipment 120 described herein, and may be operable to receive signals (e.g., sensor data, sensor measurements) from and transmit signals (e.g., control data, control signals, control commands) to the equipment to perform various operations described herein. The controller 193 may store executable program code, instructions, and/or operational parameters or setpoints, including for implementing one or more aspects of methods and operations described herein. The controller 193 may be located within and/or outside of the facility 191.

The control workstation 192 may be operable for entering or otherwise communicating control commands to the controller 193 by the rig personnel 118, and for displaying or otherwise communicating information from the controller 193 to the rig personnel 118. The control workstation 192 may comprise a plurality of human-machine interface (HMI) devices, including one or more input devices 194 (e.g., one or more keyboards, mouse devices, joysticks, touchscreens, etc.) and one or more output devices 195 (e.g., one or more video monitors, touchscreens, printers, audio speakers, etc.). Communication between the controller 193, the input and output devices 194, 195, and components of the wellsite equipment may be via wired and/or wireless communication means. However, for clarity and ease of understanding, such communication means are not depicted, and a person having ordinary skill in the art will appreciate that such communication means are within the scope of the present disclosure.

Well construction systems within the scope of the present disclosure may include more or fewer components than as described above and/or depicted in FIG. 1. Additionally, various equipment and/or subsystems of the well construction system 100 shown in FIG. 1 may include more or fewer components than as described above and depicted in FIG. 1. For example, various engines, motors, hydraulics, actuators, valves, and/or other components not explicitly described herein may be included in the well construction system 100 and are within the scope of the present disclosure.

Figure 2:
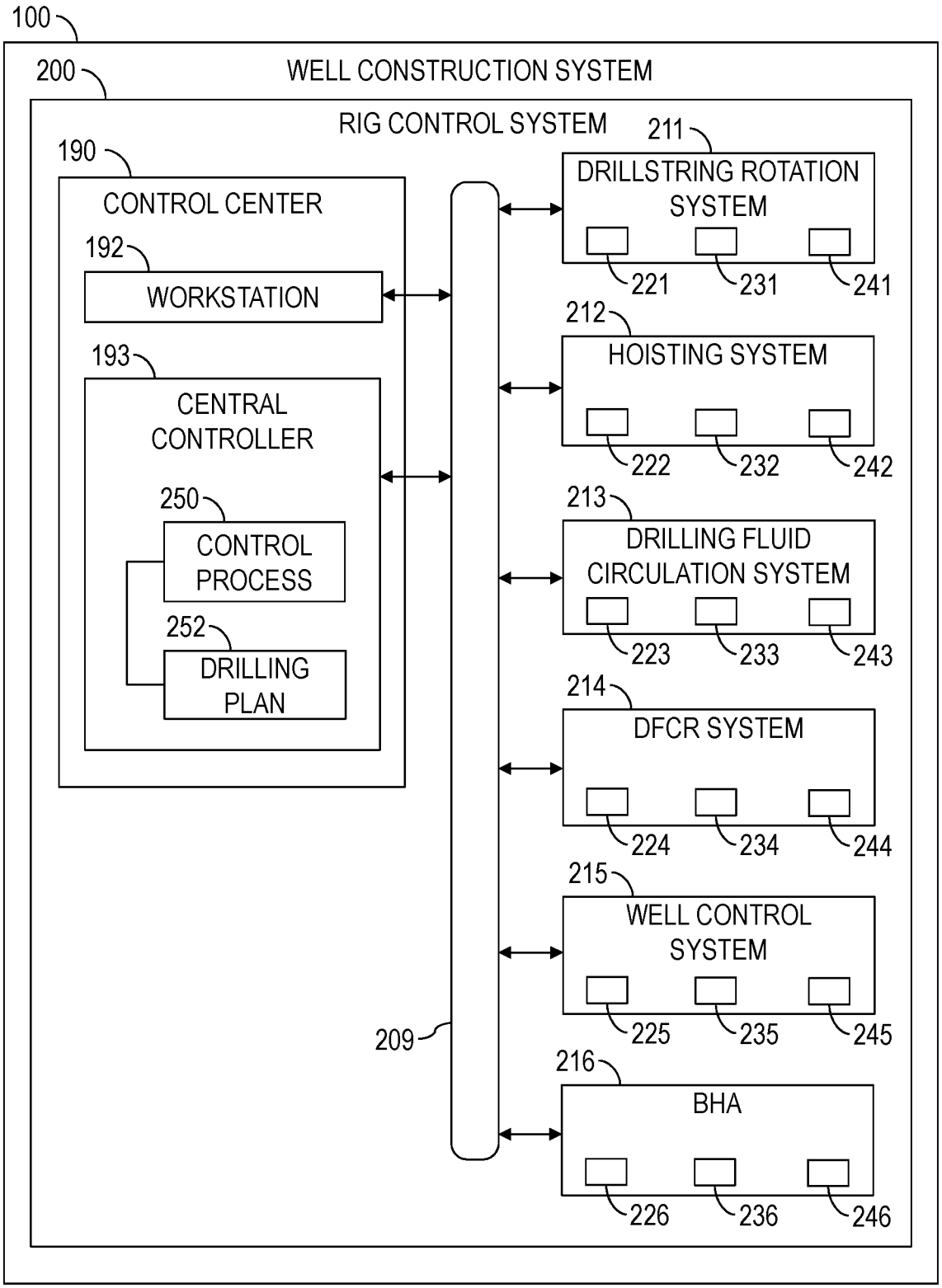
FIG. 2 is a schematic view of at least a portion of an example implementation of a rig control system according to one or more aspects of the present disclosure.

The present disclosure further provides various implementations of systems and/or methods for controlling one or more portions of the well construction system 100. FIG. 2 is a schematic view of at least a portion of an example implementation of a drilling rig control system 200 (hereinafter "rig control system") for monitoring and controlling various equipment, portions, and subsystems of the well construction system 100 shown in FIG. 1. The rig control system 200 may comprise one or more features of the well construction system 100, including where indicated by the same reference numbers. Accordingly, the following description refers to FIGS. 1 and 2, collectively. However, the rig control system 200 depicted in FIG. 2, as well as other implementations of rig control systems also within the scope of the present disclosure, may also be applicable or readily adapted for utilization with other implementations of well construction systems also within the scope of the present disclosure.

The various pieces of well construction equipment described above and shown in FIGS. 1 and 2 may each comprise one or more actuators (e.g., combustion, hydraulic, and/or electrical), which when operated may cause the corresponding well construction equipment to perform intended actions (e.g., work, tasks, movements, operations, etc.). Each piece of well construction equipment may further carry or comprise one or more sensors disposed in association with a corresponding actuator or other portion of the piece of equipment. Each sensor may be communicatively connected with a corresponding equipment controller, and may be operable to generate sensor data (e.g., electrical sensor signals or measurements) indicative of an operational (e.g., mechanical, physical) status of the corresponding actuator or component, thereby permitting the operational status of the actuator to be monitored by the equipment controller. The sensor data may be utilized by the equipment controller as feedback data, permitting operational control of the piece of well construction equipment and coordination with other well construction equipment. Such sensor data may be indicative of performance of each individual actuator and, collectively, of the entire piece of well construction equipment.

The rig control system 200 may be in real-time communication with one or more components, subsystems, systems, and/or other equipment of the well construction system 100 that are monitored and/or controlled by the rig control system 200. As described above, the equipment of the well construction system 100 may be grouped into several subsystems, each operable to perform a corresponding operation and/or a portion of the well construction operations described herein. For example, the subsystems may include a drillstring rotation system 211 (e.g., the top drive 136), a hoisting system 212 (e.g., the drawworks 146 and the blocks 142, 144), a drilling fluid circulation system 213 (e.g., the mud pump 170 and the fluid conduit 172), a drilling fluid cleaning and reconditioning (DFCR) system 214 (e.g., the drilling fluid reconditioning equipment 184 and the containers 166, 188), a well control system 215 (e.g., a BOP stack, a choke manifold, and/or other components of the fluid control equipment 180), and the BHA 120 (designated in FIG. 2 by reference number 216), among other examples. The control workstation 192 may be utilized to monitor, configure, control, and/or otherwise operate one or more of the subsystems 211-216.

Each of the well construction subsystems 211-216 may further comprise various communication equipment (e.g., modems, network interface cards, etc.) and communication conductors (e.g., cables) communicatively connecting the equipment (e.g., sensors and actuators) of each subsystem 211-216 with the control workstation 197 and/or other equipment. Although the well construction equipment described above and shown in FIG. 1 is associated with certain wellsite subsystems 211-216, such associations are merely examples that are not intended to limit or prevent such well construction equipment from being associated with two or more of the wellsite subsystems 211-216 and/or different wellsite subsystems 211-216.

One or more of the subsystems 211-216 may include one or more local controllers 221-226, each operable to control various well construction equipment of the corresponding subsystem 211-216 and/or an individual piece of well construction equipment of the corresponding subsystem 211-216. Each well construction subsystem 211-216 includes various well construction equipment comprising corresponding actuators 241-246 for performing operations of the well construction system 100. One or more of the subsystems 211-216 may include various sensors 231-236 operable to generate sensor data (e.g., signals, information, measurements, etc.) indicative of operational status of the well construction equipment of the corresponding subsystem 211-216. Each local controller 221-226 may output control data (e.g., commands, signals, information) to one or more actuators 241-246 to perform corresponding actions of a piece of equipment of the corresponding subsystem 211-216. One or more of the local controllers 221-226 may receive sensor data generated by one or more corresponding sensors 231-236 indicative of operational status of an actuator or other portion of a piece of equipment of the corresponding subsystem 211-216. Although the local controllers 221-226, the sensors 231-236, and the actuators 241-246 are each shown as a single block, it is to be understood that each local controller 221-226, sensor 231-236, and actuator 241-246 may illustratively represent a plurality of local controllers, sensors, and actuators.

The sensors 231-236 may include sensors utilized for operation of the various subsystems 211-216 of the well construction system 100. For example, the sensors 231-236 may include cameras, position sensors, pressure sensors, temperature sensors, flow rate sensors, vibration sensors, current sensors, voltage sensors, resistance sensors, gesture detection sensors or devices, voice actuated or recognition devices or sensors, and/or other examples. The sensor data may include signals, information, and/or measurements indicative of equipment operational status (e.g., on or off, up or down, set or released, etc.), drilling parameters (e.g., depth, hook load, torque, etc.), auxiliary parameters (e.g., vibration data of a pump), flow rate, temperature, operational speed, position, and pressure, among other examples. The acquired sensor data may include or be associated with a timestamp (e.g., date and/or time) indicative of when the sensor data was acquired. The sensor data may also or instead be aligned with a depth or other drilling parameter.

The local controllers 221-226, the sensors 231-236, and the actuators 241-246 may be communicatively connected with a central controller 193. For example, the local controllers 221-226 may be in communication with the sensors 231-236 and the actuators 241-246 of the corresponding subsystems 211-216 via local communication networks (e.g., field buses) (not shown) and the central controller 193 may be in communication with the subsystems 211-216 via a central communication network 209 (e.g., a data bus, a field bus, a wide-area-network (WAN), a local-area-network (LAN), etc.). The sensor data generated by the sensors 231-236 of the subsystems 211-216 may be made available for use by the central controller 193 and/or the local controllers 221-226. Similarly, control data output by the central controller 193 and/or the local controllers 221-226 may be automatically communicated to the various actuators 241-246 of the subsystems 211-216, perhaps pursuant to predetermined programming, such as to facilitate well construction operations and/or other operations described herein. Although the central controller 193 is shown as a single device (i.e., a discrete hardware component), it is to be understood that the central controller 193 may be or comprise a plurality of equipment controllers and/or other electronic devices collectively operable to perform operations (i.e., computational processes or methods) described herein.

The sensors 231-236 and actuators 241-246 may be monitored and/or controlled by corresponding local controllers 221-226 and/or the central controller 193. For example, the central controller 193 may be operable to receive sensor data from the sensors 231-236 of the subsystems 211-216 in real-time, and to output real-time control data directly to the actuators 241-246 of the subsystems 211-216 based on the received sensor data. However, certain operations of the actuators 241-246 of one or more of the subsystems 211-216 may be controlled by a corresponding local controller 221-226, which may control the actuators 241-246 based on sensor data received from the sensors 231-236 of the corresponding subsystem 211-216 and/or based on control data received from the central controller 193.

The rig control system 200 may be a tiered control system, wherein control of the subsystems 211-216 of the well construction system 100 may be provided via a first tier of the local controllers 221-226 and a second tier of the central controller 193. The central controller 193 may facilitate control of one or more of the subsystems 211-216 at the level of each individual subsystem 211-216. For example, in the hoisting system 212, sensor data may be fed into the local controller 242, which may respond to control the actuators 232. However, for control operations that involve more than one of the subsystems 211-216, the control may be coordinated via the central controller 193 being operable to coordinate control of well construction equipment of two, three, four, or more (or each) of the subsystems 211-216. For example, coordinated control operations may include the control of WOB during drilling. The WOB may be affected by the drillstring rotation system 211 (e.g., top drive torque), the hoisting system 212 (e.g., hook load, tension in the support line 148, speed/direction of the drawworks 146 and/or the travelling block 142, etc.), the drilling fluid circulation system 213 (e.g., mud pressure and/or flow rate), and the BHA 120/216 (e.g., mud motor delta pressure). Thus, when it is intended to maintain a certain WOB during drilling, the central controller 193 may output control data to two or more of the participating subsystems 211-213, 216. Accordingly, the central controller 193 may be operable as an autodriller that communicates with the local controllers 221-226 to control WOB, ΔP, and $T_{TD}$ so as to optimize ROP.

The downhole controller 134, the central controller 193, the local controllers 221-226, and/or other controllers or processing devices (individually or collectively referred to hereinafter as an "equipment controller") of the rig control system 200 may each or collectively be operable to receive and store machine-readable and executable program code instructions (e.g., computer program code, algorithms, programmed processes or operations, etc.) on a memory device (e.g., a memory chip) and then execute the program code instructions to run, operate, or perform a control process for monitoring and/or controlling the well construction equipment of the well construction system 100. The central controller 193 may run (i.e., execute) a control process 250 (e.g., a coordinated control process or anther computer process) and each local controller 221-226 may run a corresponding control process (e.g., a local control process or another computer processor, not shown). Two or more of the local controllers 221-226 may run their local control processes to collectively coordinate operations between well construction equipment of two or more of the subsystems 211-216.

The control process 250 of the central controller 193 may operate as a mechanization manager of the rig control system 190, coordinating operational sequences of the well construction equipment of the well construction system 100. The control process of each local controller 221-226 may facilitate a lower (e.g., basic) level of control within the rig control system 200 to operate a corresponding piece of well construction equipment or a plurality of pieces of well construction equipment of a corresponding subsystem 211-216. Such control process may facilitate, for example, starting, stopping, and setting or maintaining an operating speed of a piece of well construction equipment.

The control process 250 of the central controller 193 may output control data directly to the actuators 241-246 to control the well construction operations. The control process 250 may also or instead output control data to the control process of one or more local controllers 221-226, wherein each control process of the local controllers 221-226 may then output control data to the actuators 241-246 of the corresponding subsystem 211-216 to control a portion of the well construction operations performed by that subsystem 211-216. Thus, the control processes of equipment controllers (e.g., central controller 193, local controllers 221-226, etc.) of the rig control system 200 individually and collectively perform monitoring and control operations described herein, including monitoring and controlling well construction operations. The program code instructions forming the basis for the control processes described herein may comprise rules (e.g., algorithms) based upon the laws of physics for drilling and other well construction operations.

Each control process being run by an equipment controller of the rig control system 200 may receive and process (i.e., analyze) sensor data from one or more of the sensors 231-236, according to the program code instructions, and generate control data (i.e., control signals or information) to operate or otherwise control one or more of the actuators 241-246 of the well construction equipment. Equipment controllers within the scope of the present disclosure can include, for example, programmable logic controllers (PLCs), industrial computers (IPCs), personal computers (PCs), soft PLCs, variable frequency drives (VFDs), and/or other controllers or processing devices operable to store and execute program code instructions, receive sensor data, and output control data to cause operation of the well construction equipment based on the program code instructions, sensor data, and/or control data.

The control workstation 192 may be communicatively connected with the central controller 193 and/or the local controllers 221-226 via the communication network 209, such as to receive sensor data from the sensors 231-236 and transmit control data to the central controller 193 and/or the local controllers 221-226 to control the actuators 241-246. Accordingly, the control workstation 192 may be utilized by rig personnel (e.g., a driller 119) to monitor and control the actuators 241-246 and other portions of the subsystems 211-216 via the central controller 193 and/or local controllers 221-226.

The central controller 193 may comprise a memory device operable to receive and store a well construction plan 252 (e.g., a drilling plan) for drilling and/or otherwise constructing a planned well. The well construction plan 252 may include well specifications, drillstring specifications, operational parameters, schedules, and other information indicative of the planned well and the well construction equipment of the well construction system 100. For example, the well construction plan 252 may include properties of the subterranean formation(s) 106 through which the planned well is to be drilled, the path (e.g., direction, curvature, orientation, etc.) along which the planned well is to be drilled through the formation(s) 106, the depth (e.g., true vertical depth (TVD), measured depth (MD), etc.) of the planned well, operational specifications (e.g., power output, weight, torque capabilities, speed capabilities, dimensions, size, etc.) of the well construction equipment (e.g., of the top drive 136, the mud pumps 170, the downhole mud motor 126, etc.) that is planned to be used to construct the planned well, and/or specifications (e.g., diameter, length, weight, etc.) of tubulars (e.g., drill pipe) that are planned to be used to construct the planned well. The well construction plan 252 may further include planned operational parameters of the well construction equipment during the well construction operations, such as WOB, speed (revolutions per minute, RPM) of the top drive 136, and ROP as a function of wellbore depth.

Figure 3:
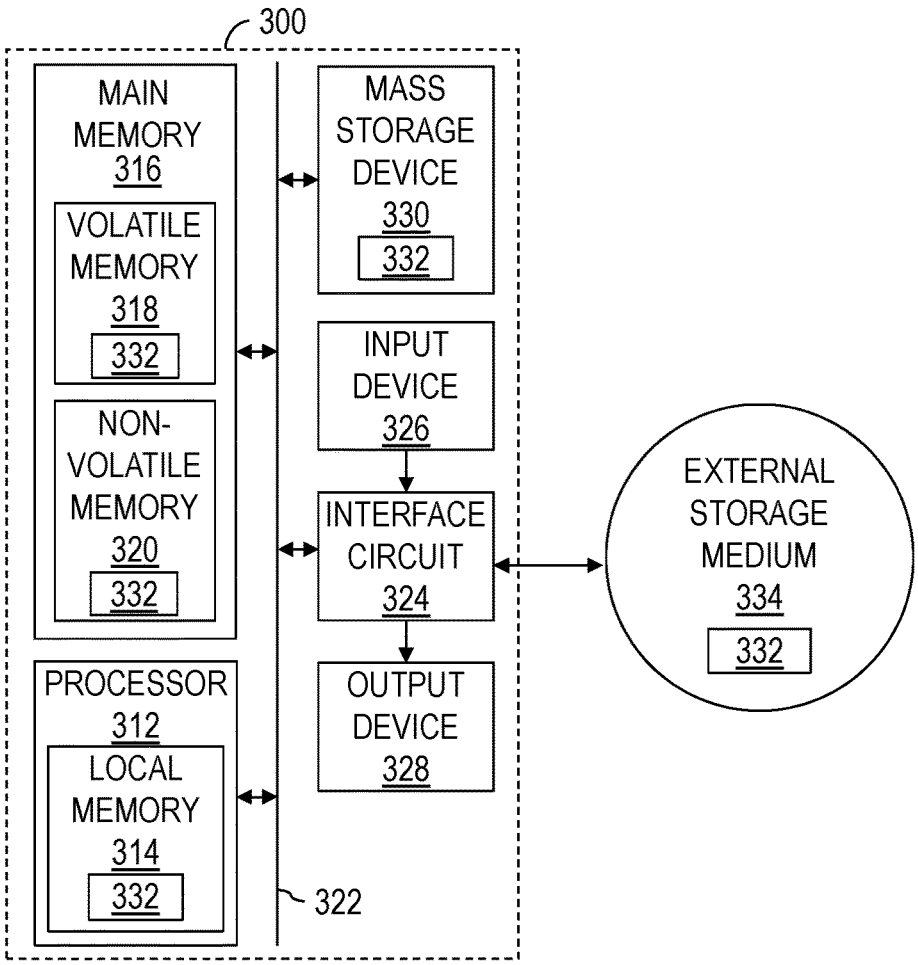
FIG. 3 is a schematic view of at least a portion of an example implementation of a processing system/device according to one or more aspects of the present disclosure.

FIG. 3 is a schematic view of at least a portion of an example implementation of a processing device 300 (or system) according to one or more aspects of the present disclosure. The processing device 300 may be or form at least a portion of one or more equipment controllers and/or other electronic devices shown in one or both of FIGS. 1 and 2. Accordingly, the following description refers to FIGS. 1-3, collectively.

The processing device 300 may be or comprise, for example, one or more processors, controllers, special-purpose computing devices, PCs (e.g., desktop, laptop, and/or tablet computers), personal digital assistants, smartphones, IPCs, PLCs, servers, internet appliances, and/or other types of computing devices. One or more instances of the processing device 300 may be or form at least a portion of the rig control system 200. For example, one or more instances of the processing device 300 may be or form at least a portion of the downhole controller 134, the central controller 193, one or more of the local controllers 221-226, and/or the control workstation 192. Although it is possible that the entirety of a single instance of the processing device 300 is implemented within one device, it is also contemplated that one or more components or functions of the processing device 300 may be implemented across multiple devices, some or an entirety of which may be at the wellsite and/or remote from the wellsite.

The processing device 300 may comprise a processor 312, such as a general-purpose programmable processor. The processor 312 may comprise a local memory 314 and may execute machine-readable and executable program code instructions 332 (i.e., computer program code) present in the local memory 314 and/or another memory device. The processor 312 may execute, among other things, the program code instructions 332 and/or other instructions and/or programs to implement the example methods and/or operations described herein. The program code instructions 332, when executed by the processor 312 of the processing device 300, may also or instead cause one or more portions or pieces of well construction equipment of a well construction system to perform the example methods and/or operations described herein. The processor 312 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Examples of the processor 312 include one or more INTEL microprocessors, microcontrollers from the ARM and/or PICO families of microcontrollers, and embedded soft/hard processors in one or more FPGAs.

The processor 312 may be in communication with a main memory 316, such as may include a volatile memory 318 and a non-volatile memory 320, perhaps via a bus 322 and/or other communication means. The volatile memory 318 may be, comprise, or be implemented by random-access memory (RAM), static RAM (SRAM), dynamic RAM (DRAM), synchronous DRAM (SDRAM), RAMBUS DRAM (RDRAM), and/or other types of RAM devices. The non-volatile memory 320 may be, comprise, or be implemented by read-only memory, flash memory, and/or other types of memory devices. One or more memory controllers (not shown) may control access to the volatile memory 318 and/or non-volatile memory 320.

The processing device 300 may also comprise an interface circuit 324, which is in communication with the processor 312, such as via the bus 322. The interface circuit 324 may be, comprise, or be implemented by various types of standard interfaces, such as an Ethernet interface, a universal serial bus (USB), a third-generation input/output (3GIO) interface, a wireless interface, a cellular interface, and/or a satellite interface, among others. The interface circuit 324 may comprise a graphics driver card. The interface circuit 324 may comprise a communication device, such as a modem or network interface card, to facilitate exchange of data with external computing devices via a network (e.g., Ethernet connection, digital subscriber line (DSL), telephone line, coaxial cable, cellular telephone system, satellite, etc.).

The processing device 300 may be in communication with various sensors, video cameras, actuators, processing devices, equipment controllers, and other devices of the well construction system via the interface circuit 324. The interface circuit 324 can facilitate communications between the processing device 300 and one or more devices by utilizing one or more communication protocols, such as an Ethernet-based network protocol (such as ProfiNET, OPC, OPC/UA, Modbus TCP/IP, EtherCAT, UDP multicast, Siemens S7 communication, or the like), a proprietary communication protocol, and/or another communication protocol.

One or more input devices 326 may also be connected to the interface circuit 324. The input devices 326 may permit rig personnel to enter the program code instructions 332, which may be or comprise control data, operational parameters, operational setpoints, a well construction drill plan, and/or database of operational sequences. The program code instructions 332 may further comprise modeling or predictive routines, equations, algorithms, processes, applications, and/or other programs operable to perform example methods and/or operations described herein. The input devices 326 may be, comprise, or be implemented by a keyboard, a mouse, a joystick, a touchscreen, a trackpad, a trackball, and/or a voice recognition system, among other examples. One or more output devices 328 may also be connected to the interface circuit 324. The output devices 328 may permit visual or other sensory perception of various data, such as sensor data, status data, and/or other example data. Each output device 328 may be, comprise, or be implemented by a video output device (e.g., a liquid crystal display (LCD), a light-emitting diode (LED) display, a cathode ray tube (CRT) display, a touchscreen, etc.), printers, and/or speakers, among other examples. The one or more input devices 326 and the one or more output devices 328 connected to the interface circuit 324 may, at least in part, facilitate the HMIs described herein.

The processing device 300 may comprise a mass storage device 330 for storing data and program code instructions 332. The mass storage device 330 may be connected to the processor 312, such as via the bus 322. The mass storage device 330 may be or comprise a tangible, non-transitory storage medium, such as a floppy disk drive, a hard disk drive, a compact disk (CD) drive, and/or digital versatile disk (DVD) drive, among other examples. The processing device 300 may be communicatively connected with an external storage medium 334 via the interface circuit 324. The external storage medium 334 may be or comprise a removable storage medium (e.g., a CD or DVD), such as may be operable to store data and program code instructions 332.

As described above, the program code instructions 332 may be stored in the mass storage device 330, the main memory 316, the local memory 314, and/or the removable storage medium 334. Thus, the processing device 300 may be implemented in accordance with hardware (perhaps implemented in one or more chips including an integrated circuit, such as an ASIC), or may be implemented as software or firmware for execution by the processor 312. In the case of firmware or software, the implementation may be provided as a computer program product including a non-transitory, computer-readable medium or storage structure embodying computer program code instructions 332 (i.e., software or firmware) thereon for execution by the processor 312. The program code instructions 332 may include program instructions or computer program code that, when executed by the processor 312, may perform and/or cause performance of example methods, processes, and/or operations described herein.

The present disclosure is further directed to example methods (e.g., operations, processes, actions) for monitoring and controlling well construction equipment of a well construction system. The example methods may be performed utilizing or otherwise in conjunction with at least a portion of one or more implementations of one or more instances of the apparatus shown in one or more of FIGS. 1-3, and/or otherwise within the scope of the present disclosure. For example, the methods may be performed and/or caused, at least partially, by a processing device, such as the processing device 300 executing program code instructions 332 according to one or more aspects of the present disclosure. Thus, the present disclosure is also directed to a non-transitory, computer-readable medium comprising computer program code that, when executed by the processing device, may cause such processing device to perform the example methods described herein. Thus, the following description refers to apparatus shown in one or more of FIGS. 1-3 and methods that can be performed by such apparatus. However, the methods may also be performed in conjunction with implementations of apparatus other than those depicted in FIGS. 1-3 that are also within the scope of the present disclosure.

The present disclosure introduces one or more aspects by which robust autodriller performance may be achieved through scaling of the proportional gain and the integral gain in the proportional-integral (PI) controllers of the autodriller based on drilling context. The autodriller and/or PI controllers may be implemented via the central controller 193, the local controller 222 of the hoisting system 212, and/or one or more other controllers, processors, and/or processing devices described above. As described above, the autodriller control logic uses PI controllers for multiple parameters (e.g., ROP, WOB, ΔP) to attempt to increase ROP until reaching a user-defined setpoint/limit of one or more input parameters. When the setpoint/limit of the one or more input parameters is reached, the autodriller adjusts the ROP to achieve that parameter setpoint/limit.

The contextual scaling may include scaling the proportional gain by a function of the average ROP and the ROP setpoint, divided by a controlling parameter setpoint (e.g., WOB, ΔP, or $T_{TD}$). The integral gain is determined based on a quotient of the proportional gain and a time constant τ, which is determined based on the current drilling context, as described below. Other autodriller parameters, such as the filters applied to ROP, WOB, ΔP, and $T_{TD}$, may also be adapted based on the current drilling context in a manner similar to one or more aspects described below.

The transient behavior of the drilling system when the WOB, ΔP, and/or $T_{TD}$ setpoints are changed depends on the proportional/integral parameters and on parameters that describe the dynamics of the drilling process. The autodriller of the present disclosure combines data acquired during transients and data acquired when at set values, so as to estimate drilling process parameters and to optimize the PI controller parameters. In general, control of the axial motion of the drilling process (e.g., via operation of the hoisting system 212) is separated into three separate types of information: contextual information, such as bit depth, drillpipe geometry and material properties, BHA configuration (e.g., whether or not the BHA 120 includes the mud motor 126), nominal flowrate, and nominal RPM, among other examples; parameters that define the behavior of the control algorithm that is controlling the axial motion of the drillstring, such as the PI controller gains; and the control algorithm itself, which utilizes sensor data to output an axial velocity command. The processing described below may be performed in real-time. The processing may be performed locally on a PLC (e.g., the hoisting system controller 222), or at a higher level in a control software stack (e.g., of the central controller 193, such as the control process 250), with the resulting control parameters (proportional and integral gains) passed to the autodriller software running on the PLC.

The processing inputs may include: the proportional gain (a); two motor parameters, $T_{TD}$/psi and RPM/GPM of the mud motor 126; drilling inputs such as ROP present value (PV), ΔP setpoint (SP), flowrate SP, top drive RPM, and WOB PV; and drillpipe inputs such as length, outer diameter (OD), and inner diameter (ID). The proportional gain, motor parameters, and drillpipe inputs may be entered by the user (e.g., via the HMI or other input devices described above) or may be obtained from an overall supervisory or planning software (e.g., of the central controller 193, such as the drilling plan 252). The drilling inputs may be entered by a user, measured, and/or output from a drilling optimization routine running in a supervisory or middle layer above PLCs (e.g., of the central controller 193, such as the control process 250 and/or the drilling plan 252).

Scaling the proportional gain of the PI controller may be via a function of time averaged ROP and the ROP setpoint, divided by the control parameter setpoint. For example, the proportional gain $a_{WOB}$ in the WOB control loop, the proportional gain $a_{\Delta P}$ in the ΔP control loop, and the proportional gain $a_{T_{TD}}$ in the $T_{TD}$ control loop may be determined utilizing Equations (1A)-(1C) set forth below.

$$a_{WOB} = \kappa_{WOB}\frac{\alpha_{WOB}ROP_{AV} + \beta_{WOB}ROP_{SP}}{WOB_{SP}} \tag{1A}$$

$$a_{\Delta P} = \kappa_{\Delta P}\frac{\alpha_{\Delta P}ROP_{AV} + \beta_{\Delta P}ROP_{SP}}{\Delta P_{SP}} \tag{1B}$$

$$a_{T_{TD}} = \kappa_{T_{TD}}\frac{\alpha_{T_{TD}}ROP_{AV} + \beta_{T_{TD}}ROP_{SP}}{T_{TD_{SP}}} \tag{1C}$$

However, for ease of explanation, Equations (1A)-(1C) may be hereafter referred to as Equation (1) utilizing the WOB control loop as an example for each of the three control loops, as set forth below.

$$a = \kappa\frac{\alpha ROP_{AV} + \beta ROP_{SP}}{WOB_{SP}} \tag{1}$$

where κ is an overall positive constant, such as between 0.5 and 4; α and β are positive coefficients, such as between 0 and 1; $ROP_{AV}$ is a time-averaged ROP value, such as a low-pass filtered value of the measured ROP; $ROP_{SP}$ is the ROP setpoint of the autodriller; and $WOB_{SP}$ is the WOB setpoint of the autodriller.

The integral gain is determined based on the proportional gain a and the time constant τ. The following description provides example implementations for determining the time constant τ.

A model for describing the relationship between the motion of the top and bottom of the drillstring and WOB may be as set forth below in Equation (2).

$$v_{surface} - v_{bit} = \lambda\frac{dW}{dt} \tag{2}$$

where $v_{surface}$ is the axial velocity of the top of the drillstring ("surface ROP"), $v_{bit}$ is the axial velocity of the bit 124 (i.e., ROP), W is WOB, t is time, and λ is the compliance of the drillstring and system between the measuring points (physical locations) of $v_{surface}$ and $v_{bit}$.

The bit velocity/ROP depends on the WOB and generally increases when WOB increases. For example, a linear dependency between bit velocity/ROP and WOB may be appropriate for many bits, as set forth below in Equation (3).

$$v_{bit}=k(W-W_0) \tag{3}$$

where k is a constant and $W_0$ is an offset which may be zero. When the dependency is not linear, the dependency may still be described by Equation (3) over small WOB variations.

Existing autodrillers can control the rate at which the drillstring moves down and, therefore, can permit drilling at a controlled, surface measured ROP ("surface ROP") without additional control architecture. However, in order to control another variable using surface ROP, an additional control loop is utilized. Example variables used for such control are WOB, ΔP, and $T_{TD}$. It is in this context, for example, that aspects of the present disclosure may be utilized for WOB control, ΔP control, and $T_{TD}$ control. However, other variables may also be controlled using surface ROP, and one or more aspects of the present disclosure may also be applicable or readily adaptable for use in controlling such other variables.

If drilling is steady at a surface ROP ($v_1$), the drilling is under ROP control, and the formation being drilled is uniform, then WOB will also be generally constant, such as given by Equation (4) set forth below.

$$W_1 = W_0 + \frac{v_1}{k} \tag{4}$$

where $W_1$ is a first WOB and $v_1$ is axial velocity of the top of the drillstring (surface ROP) at $W_1$.

If the surface ROP is changed to $v_2$, then after a transitional time it will asymptote to a second WOB, $W_2$, as set forth below in Equation (5).

$$W_2 = W_0 + \frac{v_2}{k} \tag{5}$$

Combining Equations (2) and (3) set forth above, and solving for WOB, the transition will be exponential between $W_1$ and $W_2$. For example, if the surface ROP is changed at time ti, then WOB as a function of time, W(t), may be as set forth below in Equation (6).

$$W(t)=W_2+(W_1+W_2)e^{(-\eta(t-t1))} \tag{6}$$

where $\eta=\lambda/k$.

The inverse of η has the units of time and is often referred to as the drill-off time. For example, as if $v_2$ is zero, then the end-weight is zero, or at least the weight at which drilling ceases. If this exponential transition can be captured, then the rate-constant η can be determined from the data, such as by utilizing Fourier transform, Prony's method, and/or other means. In implementations in which the data utilized to determine η is noisy, small changes may be made in opposing directions at sufficiently long intervals, the results can be summed (e.g., with a sign appropriate to the sign of the change in surface ROP), and the rate constant η can be determined from the summed data.

The above-described determination of contextual scaling of proportional and integral gains may be utilized for PI-based control of WOB. For example, the surface ROP may be set according to Equation (7) set forth below.

$$v_{surface} = -a(W - W_d) - \frac{a}{\tau}\int (W - W_d) \tag{7}$$

where $W_d$ is the desired WOB (normally constant, but which may vary), and the integral denotes a sum over past times.

Regardless of the surface ROP, the downhole ROP may be determined as a function of time t, as set forth below in Equation (8).

$$v_{bit}(t)=\eta\int_{s=-\infty}^{s=0} v_{surface}(t+s)e^{\eta s}ds \tag{8}$$

where s is an integral variable.

If drilling is conducted utilizing WOB control, then Equations (2), (3) and (7) can be solved simultaneously. Equating $v_{surface}$ in Equations (3) and (7) and differentiating leads to a differential equation, such as set forth below in Equation (9).

$$\frac{a}{\tau}W_d = \frac{a}{\tau}W + (a+k)\frac{dW}{dt} + \lambda\frac{d^2W}{dt^2} \tag{9}$$

The kernel of Equation (9) has two solutions that are exponential with rate constants $x^+$ and $x^-$, such as set forth below in Equation (10).

$$x^{\pm} = \frac{(a+k)}{2\lambda} \pm \sqrt{\frac{(a+k)^2}{4\lambda^2} - \frac{a}{\lambda\tau}} \tag{10}$$

The response of the system to step changes in parameters at time $t_0$ will be a sum of exponential decays with decay rates $x^+$ and $x^-$. Thus, by making a change to the desired WOB, observing the resulting effect on surface ROP and WOB (such as via Fourier transform, Prony's method, and/or other methods for determining the rate constants (e.g., fitting to the theoretical solution)), the constants $x^+$ and $x^-$ may be estimated. The values of λ and k (or various combinations thereof) may then be estimated, such as set forth below in Equations (11) and (12).

$$\lambda = \frac{a}{\lambda x^+ x^-} \tag{11}$$

$$k = (x^+ + x^-)\lambda - a \tag{12}$$

Equation (10) may then be rewritten as set forth below in Equation (13).

$$x \pm = \frac{a+k}{2\lambda}\left(1 \pm \sqrt{1 - \frac{\tau_0}{\tau}}\right) \tag{13}$$

where $$\tau_0 = \frac{4a\lambda}{(a+k)^2} \tag{14}$$

Thus, while the control parameter a (the proportional control gain), in conjunction with the drilling parameters k and λ, governs the overall convergence of the control system when subject to disturbances, the ratio of τ to $\tau_0$ controls the amount of oscillation. Existing autodrillers permit the operator to adjust the proportional and integral gains, but the ratio between the two gains (corresponding to the time constant τ) is kept constant. However, having estimated λ and k (either from the response to changes in desired WOB or by other methods) according to aspects of the present disclosure, for a chosen proportional gain, the system can now automatically set τ, such as in terms of $\tau_0$. For example, τ may be set to be linearly proportional to $\tau_0$ determined as described above.

The above-described determination of contextual scaling of proportional and integral gains may also be utilized for PI-based control of pressure differential across the mud motor 126 (e.g., as may be determined from surface pressure). In existing systems, when pressure is the control parameter, the drilling system may experience unstable oscillation. However, aspects of the present disclosure may be utilized to avoid such oscillations.

The ΔP across a positive displacement motor (PDM) is approximately proportional to the torque to which the motor is subjected. For a PDM close to the bit, such as the mud motor 126, the torque to which the motor is subjected is approximately the bit torque. Under normal conditions, the bit torque increases as WOB increases. Thus, the ΔP across the mud motor 126 increases and decreases (when drilling a uniform formation) as the WOB respectively increases and decreases. Additionally, the mud pressure at the surface increases when the ΔP across the mud motor 126 increases, such that controlling surface pressure via PI control may be regarded as being similar to the above-described PI control of WOB. However, there is a difference that arises from the compliance of the fluid inside the drillstring.

An equation similar to Equation (2) may govern the fluid flow in the drillstring, ignoring pressure drops along the drillstring, such as set forth below in Equation (15).

$$q_{surface} - q_{bit} = \Lambda \frac{dP}{dt} \tag{15}$$

where $q_{surface}$ is the flow rate at the surface, $q_{bit}$ is the flow rate through the motor and bit, P is the fluid pressure at the surface, and Λ is the fluid compliance.

Equation (15) can be rearranged as set forth below in Equation (16).

$$q_{bit} = q_{surface} - \Lambda \frac{dP}{dt} \tag{16}$$

The fluid pressure at the surface is the sum of the pressure drop through the bit and the ΔP across the motor, and the pressure drop through the bit is proportional to the square of the flow rate through the bit. Thus, the bit pressure drop when the flow through the bit is the same as the surface flow ($P_{bit0}$) may be as set forth below in Equation (17).

$$P_{bit0} = \tfrac{1}{2}\chi q_{surface}^2 \tag{17}$$

where χ is a pressure-flow constant.

Accordingly, the bit pressure drop at whatever flow ($P_{bit}$) may be estimated as set forth below in Equation (18).

$$P_{bit} \approx P_{bit0} - \chi \Lambda q_{surface} \frac{dP}{dt} = P_{bit0} - \frac{2\Lambda P_{bit0}}{q_{surface}} \frac{dP}{dt} \tag{18}$$

Thus, if the proportionality between the ΔP across the mud motor 126 and the WOB is α, then the surface pressure P may be approximated as set forth below in Equation (19).

$$P + \gamma \frac{dP}{dt} = \alpha W \tag{19}$$

where $$\gamma = \frac{2\Lambda P_{bit0}}{q_{surface}} \tag{20}$$

The PI control law for the surface velocity may then be expressed as set forth below in Equation (21).

$$v_{surface} = -a(P - P_d) - \frac{a}{\tau}\int (P - P_d) \tag{21}$$

where $P_d$ is the intended surface pressure.

Combining Equations (2), (3), (19), and (21) yields a third-order differential equation, such as set forth below in Equation (22).

$$\frac{a}{\tau}P_d = \frac{a}{\tau}P + \left(a + \frac{k}{\alpha}\right)\frac{dP}{dt} + \frac{\lambda + k\gamma}{\alpha}\frac{d^2P}{dt^2} + \frac{\lambda\gamma}{\alpha}\frac{d^3P}{dt^3} \tag{22}$$

The response of the system to changes is governed by the roots of the third-order Equation (22) derived from the coefficients of the right-hand-side of the equation, as set forth below in Equation (23).

$$0 = \frac{a\alpha}{\tau\lambda\gamma} + \left(\frac{a\alpha + k}{\gamma\lambda}\right)x + \left(\frac{1}{\gamma} + \frac{k}{\lambda}\right)x^2 + x^3 \tag{22}$$

where x is an algebraic representation of the differential term of dP/dt. For example, $x^2 = d^2P/dt^2$ and $x^3 = d^3P/dt^3$.

In order for responses to be stable, the roots of Equation (23) are non-positive, real parts. An equation of this form, where each coefficient is positive, will either have three real roots, each of which are negative, or one negative real root and a pair of complex conjugate roots. Thus, for a general equation with positive coefficients of the form set forth below in Equation (24), the roots will have negative real parts if Equation (25) set forth below holds.

$$0 = x^3 + Ax^2 + Bx + C \tag{24}$$

$$C - AB < 0 \tag{25}$$

Thus, a condition for stability may be as set forth below in Equation (26).

$$\frac{1}{\tau} < \left(\frac{1}{\gamma} + \frac{k}{\lambda}\right)\left(1 + \frac{k}{a\alpha}\right) \tag{26}$$

An optimal time constant τ may be selected as a value linearly proportional to the value determined in Equation (26). An example situation for control is when the three roots of Equation (24) coincide, in which case Equations (27) and (28) set forth below both hold.

$$B = \frac{A^2}{3} \tag{27}$$

$$C = \frac{A^3}{27} \tag{28}$$

Or, alternatively, Equations (29) and (30) set forth below.

$$a = \frac{1}{\alpha}\left[\frac{(\lambda + k\gamma)^2}{3\lambda\gamma} - k\right] = \frac{1}{3\alpha}\left[\frac{\lambda}{\gamma} + \frac{\gamma k^2}{\lambda} - k\right] \tag{29}$$

-continued $$\frac{a}{\tau} = \frac{1}{\alpha}\frac{(\lambda + k\gamma)^3}{27(\lambda\gamma)^2} \tag{30}$$

If the constants in these equations can be estimated, either from calculations based on the known geometries of the drillstring and properties of the formation, or from observations, or from some combination of the two, then Equation (29) can be used to set the control gains. Moreover, it can be seen from Equation (26) that an arise of instability can be due to the integral gain time constant $\tau$ being too small, such that a response to observed instability is to increase $\tau$ until the instability disappears. This is not possible in conventional systems where $\tau$ is a fixed system parameter. However, although the analysis of the differential equation might indicate that, with unstable roots, oscillations will grow exponentially, because in practice there are bounds on the surface velocity (that is, motion has to be downwards, so it is bounded below by zero), in actuality oscillations may grow but will stabilize at a fixed level.

Additional analysis shows that, as the pressure increases, there is a reduction in ROP at constant WOB due to the reduction in flow rate through the mud motor 126, leading to a reduced rate of rotation of the motor and the drill bit 124. Taking this through the analysis leads to a reduction in quadratic coefficient A in Equation (23) set forth above, thus leading to instability over a slightly wider range of integral gains. For example, the bit velocity of Equation (3) may be written as set forth below in Equation (31).

$$v_{bit} = k'(\omega_d + \omega_m)W \tag{31}$$

where $\omega_d$ is the drillstring rotation speed, $\omega_m$ is the motor rotation speed, and k' is a constant.

Moreover, because rotation speed is proportional to flow rate, and flow rate is surface flow rate minus compliance times the rate of change of pressure, Equation (31) may be rewritten as set forth below in Equation (32).

$$v_{bit} = k'\left(\omega_d + \phi\left(Q_0 - \Lambda\frac{dP}{dt}\right)\right)W \tag{32}$$

where $\phi$ is a constant that depends on the mud motor 126.

Linearizing for stability analysis results in Equation (33) set forth below.

$$v_{bit} = kW - \psi\frac{dP}{dt} \tag{33}$$

where $\psi$ is a positive constant obtained in terms of the other terms described above.

Taking this through leads to a differential equation as set forth below in Equation (34).

$$\frac{a}{\tau}P_d = \frac{a}{\tau}P + \left(a + \frac{k}{\alpha}\right)\frac{dP}{dt} + \frac{\lambda + k\gamma - \psi}{\alpha}\frac{d^2P}{dt^2} + \frac{\lambda\gamma}{\alpha}\frac{d^3P}{dt^3} \tag{34}$$

Thus, the stability criterion of Equation (26) may be expressed as set forth below in Equation (35).

$$\frac{1}{\tau} < \left(\frac{1}{\gamma} + \frac{k}{\lambda} - \frac{\psi}{\lambda\gamma}\right)\left(1 + \frac{k}{a\alpha}\right) \tag{35}$$

Note that this reduces the parameter range for stability.

This could be applied by selection of an optimal $\tau$, such as a value linearly proportional to the value determined via Equation (35). The resulting control situation may be as set forth below in Equations (36) and (37).

$$a = \frac{1}{\alpha}\left[\frac{(\lambda + k\gamma - \psi)^2}{3\lambda\gamma} - k\right] = \frac{1}{3\alpha}\left[\frac{\lambda}{\gamma} + \frac{\gamma k^2}{\lambda} - k - 2\psi\left(\frac{1}{\gamma} + \frac{k}{\lambda}\right)\right] \tag{36}$$

$$\frac{a}{\tau} = \frac{1}{\alpha}\frac{(\lambda + k\gamma - \psi)^3}{27(\lambda\gamma)^2} \tag{37}$$

If the system is not unstable (and it can usually be made stable by increasing $\tau$ until oscillations die away), then by making small changes to the system and observing the response in surface velocity, weight, and pressure, and then using a method such as Prony's method, the exponential solutions to Equation (23) can be estimated, from which the various parameters of the system can be estimated. Alternatively, some of the parameters can be determined by other means (for example, the time constant $\gamma$ can be estimated by observing the time for the surface pressure to drop to zero when the pumps are stopped) and combined with the exponential decays to estimate parameters. The parameters k, $\lambda$, $\alpha$, and $\psi$ may also be obtained by other means, such as from the steady state response of the system, and from theoretical calculations. Regardless of how they are obtained, they may then be used in the choice of gains for the PI controller. They may be used to choose the time constant $\tau$ that provides stability according to Equation (26) or Equation (35). In some implementations within the scope of the present disclosure, utilizing Equation (35) may provide more stability than when utilizing Equation (26).

Other autodriller parameters, such as the filters applied to ROP, WOB, $\Delta P$, and $T_{TD}$, may similarly be adapted based on the current drilling context. For example, the parameters may be filtered at a cutoff frequency that may be configured to depend upon the relevant time constant determined as described above. Thus, for example, the cutoff frequency may be inversely proportional to the determined time constant.

Figure 4:
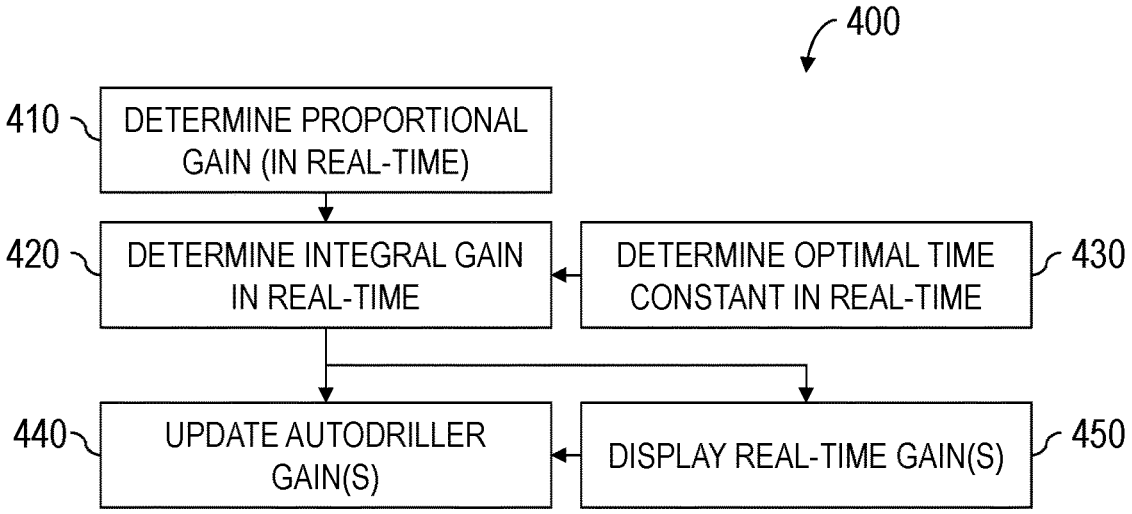
FIG. 4 is a flow-chart diagram of at least a portion of an example implementation of a method according to one or more aspects of the present disclosure.

FIG. 4 is a flow-chart diagram of at least a portion of an example implementation of a method 400 for utilizing the aspects described above, applicable for both the weight and pressure PI control. The method 400 comprises determination 410 (perhaps in real-time) of the proportional gain and the determination 420 of the integral gain in real-time. For example, determining 420 the integral gain utilizes the determined 410 proportional gain and comprises real-time determination 430 of an optimal time constant $\tau_0$. The proportional gain, integral gain, and/or time constant currently utilized by the autodriller controller may then be automatically updated 440 with the determined 410 proportional gain, the determined 420 integral gain, and/or the determined 430 time constant. The determined 410 proportional gain, the determined 420 integral gain, and/or the determined 430 time constant may instead be displayed 450 to rig personnel, such as via one or more of the output devices 195 shown in FIG. 1, who may then manually cause the autodriller gains to be updated 440. Determining 410 the proportional gain, determining 420 the integral gain, determining 430 the optimal time constant, and/or updating 440 the autodriller gain(s) may be performed on a predetermined and/or user-input schedule. Such schedule may be at regular time intervals (e.g., ten-minute intervals), or at action-based intervals (e.g., once per stand). The schedule may instead correspond to when a change above a threshold amount is detected. Other schedules are also within the scope of the present disclosure, including combinations of the above examples.

Determining 410 the proportion gain, determining 420 the integral gain, and determining 430 the optimal time constant may be as described above. For example, determining 430 the optimal time constant $\tau_0$ may utilize Equation (38) set forth below, for the ΔP integral gain computation, or Equation (39) set forth below, for the WOB integral gain computation, each of which are based on the description above.

$$\tau_0 = \frac{C1}{\left(\frac{1}{\gamma} + \frac{k}{\lambda}\right)\left(1 + \frac{k}{a\alpha}\right)} \tag{38}$$

$$\tau_0 = C2\frac{4a\lambda}{(a+k)^2} \tag{39}$$

where C1 and C2 are the tunable constants.

Figure 5:
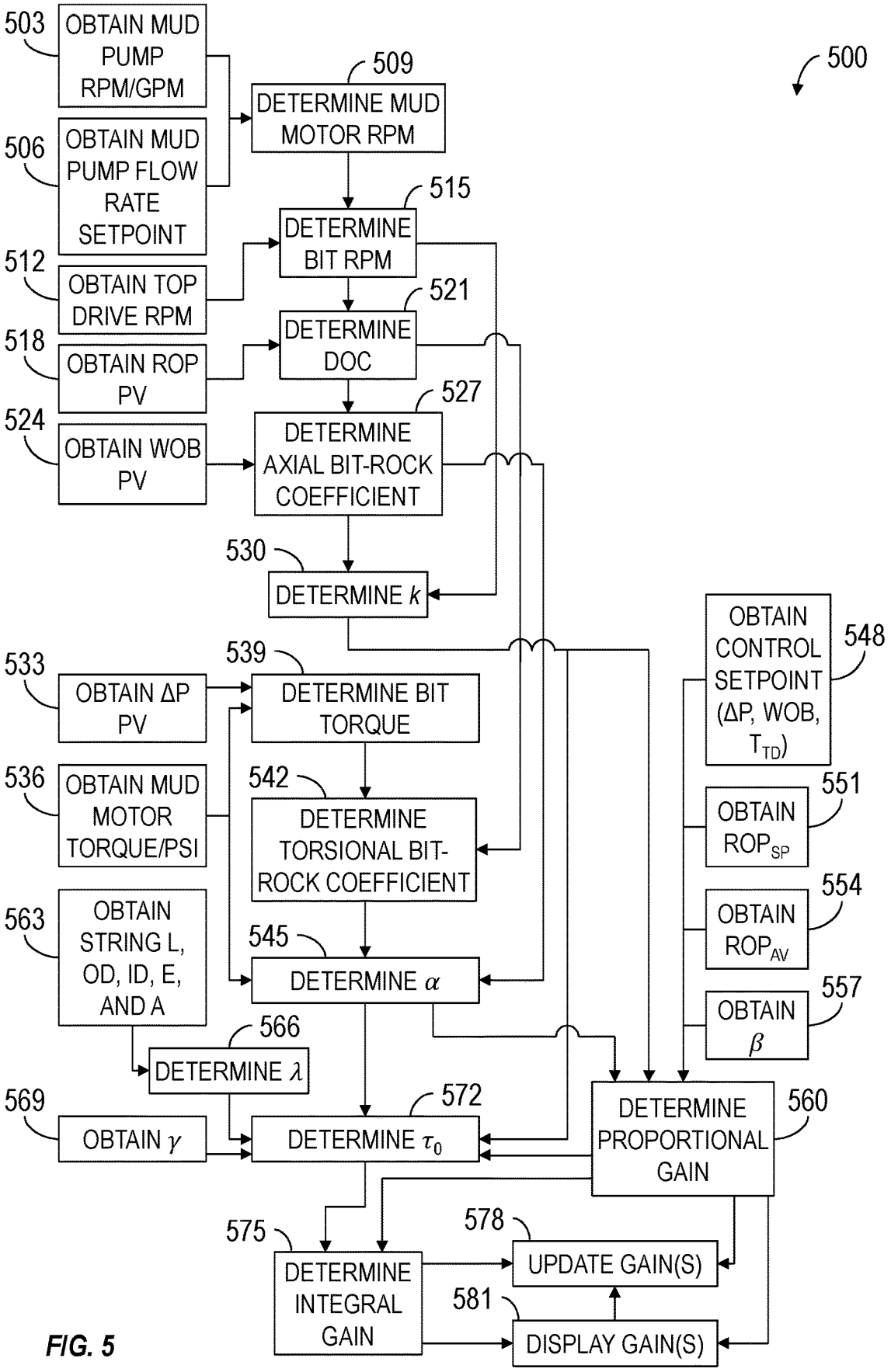
FIG. 5 is a flow-chart diagram of at least a portion of an example implementation of a method according to one or more aspects of the present disclosure.

FIG. 5 is a flow-chart diagram of at least a portion of an example implementation of a method 500 of real-time determination of the optimal time constant $\tau_0$ via Equation (38) or (39), described in the example implementation depicted in FIG. 1. The method 500 is an example implementation of the method 400 shown in FIG. 4. At least a portion of the method 500 may be performed by or otherwise in conjunction with one or more instances of apparatus depicted in one or both of FIGS. 2 and 3. Description below pertaining to obtain various parameters may be performed by or otherwise in conjunction with the sensors, HMIs, and/or other input and/or processing devices described above.

The method 500 includes obtaining 503 the RPM/GPM of the mud motor 126. The RPM/GPM is a characterization of the motor RPM that results from a given surface flowrate (in gallons per minute). If one ignores leakage in the motor and compression of the fluid flowing, there is a direct linear relationship between the flowrate and the rotation speed of the motor 126. The RPM/GPM may be obtained 503 utilizing sensor data described above. The method 500 also comprises obtaining 506 the flowrate setpoint of the mud motor 126 (Flowrate SP), such as may be input via an HMI and/or otherwise as described above. The method 500 also comprises determining 509 the speed of the mud motor 126 (Motor RPM) based on the obtained 503 RPM/GPM and the obtained 506 flow rate setpoint. For example, determining 509 Motor RPM may utilize Equation (40) set forth below.

$$\text{Motor RPM} = \text{Flowrate SP} * \text{RPM/GPM} \tag{40}$$

The method 500 also comprises obtaining 512 the speed of the top drive 136 (TD RPM) and determining 515 the speed of the drill bit 124 (Bit RPM) based on the obtained 512 TD RPM and the determined 509 Motor RPM. For example, determining 515 the Bit RPM may utilize Equation (41) set forth below.

$$\text{Bit RPM} = \text{TD RPM} + \text{Motor RPM} \tag{41}$$

The method 500 also comprises obtaining 518 the current $ROP_{PV}$ and determining 521 the Depth of Cut (DOC, the distance drilled per bit revolution) based on the obtained 518 $ROP_{PV}$ and the determined 515 Bit RPM. For example, determining 521 the DOC may utilize Equation (42) set forth below.

$$\text{DoC} = \text{ROP PV/Bit RPM} \tag{42}$$

The method 500 also comprises obtaining 524 the current $WOB_{PV}$ and determining 527 the axial bit-rock coefficient based on the obtained 524 $WOB_{PV}$ and the determined 524 DOC. For example, determining 527 the axial bit-rock coefficient may utilize Equation (43) set forth below.

$$\text{Axial bit-rock coefficient} = \text{WOB PV/DoC} \tag{43}$$

The method 500 also comprises determining 530 the constant k based on the determined 515 Bit RPM and the determined 527 axial bit-rock coefficient. For example, determining 530 the constant k utilize Equation (44) set forth below.

$$k = \text{Bit RPM/Axial bit-rock coefficient} \tag{44}$$

The method 500 also comprises obtaining 533 the current ΔP (ΔP PV) and obtaining 536 the torque/psi of the mud motor 126. The torque/psi is a characterization of the amount of pressure drop across the mud motor 126 (in psi, pounds per square inch) that generates a given amount of torque (or vice versa). The method 500 also comprises determining 539 the bit torque based on the obtained 533 ΔP PV and the obtained 536 torque/psi. For example, determining 539 the bit torque may utilize Equation (45) set forth below.

$$\text{Bit torque} = \Delta P\ \text{PV} * (\text{Torque/psi}) \tag{45}$$

The method 500 also comprises determining 542 the torsional bit-rock coefficient based on the determined 521 DOC and the determined 539 bit torque. For example, determining 542 the torsional bit-rock coefficient may utilize Equation (46) set forth below.

$$\text{Torsional bit-rock coefficient} = \text{Bit torque/DOC} \tag{46}$$

The method 500 also comprises determining 545 the proportionality a between the ΔP the WOB based on the determined 527 axial bit-rock coefficient, the obtained 536 torque/psi, and the determined 542 torsional bit-rock coefficient. For example, determining 545 the proportionality α may utilize Equation (47) set forth below.

$$\alpha = (\text{Torsional bit-rock coefficient/Axial bit-rock coefficient})/(\text{Torque/psi}) \tag{47}$$

The method 500 also comprises obtaining 548 the setpoint being controlled (ΔP, WOB, $T_{TD}$, etc.), obtaining 551 the $ROP_{SP}$, obtaining 554 the $ROP_{AV}$, and obtaining 557 the constant β described above. The proportional gain is then determined 560 based on the determined 530 constant k, the determined 545 proportionality α, the obtained 548 setpoint, the obtained 551 $ROP_{SP}$, the obtained 554 $ROP_{AV}$, and the obtained 557 constant β. For example, determining 560 the proportional gain may utilize Equation (1) set forth above.

The method 500 also comprises obtaining 563 physical parameters of the drillstring, such as length L, outer diameter OD, inner diameter ID, Young's modulus E, and cross-sectional area A. The compliance λ of the drillstring and system may then be determined 566 based on these parameters. For example, determining 566 the compliance λ may utilize Equation (48) set forth below.

$$\lambda = L/(E*A) \tag{48}$$

The method 500 also comprises obtaining 569 a value for γ (see Equation (20) set forth above). Note that γ could be a default value that scales with length or could be measured based on pressure or flowrate response time when pumps begin pumping or when pumps are turned off. The optimal time constant $\tau_0$ may then be determined 572 based on the determined 530 constant k, the determined 545 the proportionality $\alpha$, the determined proportional gain 560, the determined 566 compliance $\lambda$, and the obtained 569 $\gamma$. For example, determining 572 the optimal time constant $\tau_0$ may utilize Equation (38) set forth above, for the $\Delta P$ integral gain computation, or Equation (39) set forth above, for the WOB integral gain computation. The integral gain may then be determined 575 based on the determined 560 proportional gain and the determined 572 time constant $\tau_0$.

The proportional and/or integral gains currently used by the autodriller may be automatically or otherwise updated 578 with the determined 560 proportional gain and/or the determined 575 integral gain. For example, the current proportional and/or integral gains and the newly determined 560, 575 proportional and/or integral gains may be displayed 581 to rig personnel, such as via one or more output devices 195 shown in FIG. 1, who may sometimes decide to update 578 the current proportional and/or integral gains with the newly determined 560, 575 proportional and/or integral gains.

As described above with reference to FIG. 4, the method 500 may be performed on a predetermined and/or user-input schedule. Such schedule may be at regular time intervals (e.g., ten-minute intervals), or at action-based intervals (e.g., once per stand). The schedule may instead correspond to when a change above a threshold amount is detected. Other schedules are also within the scope of the present disclosure, including combinations of the above examples.

Figure 6:
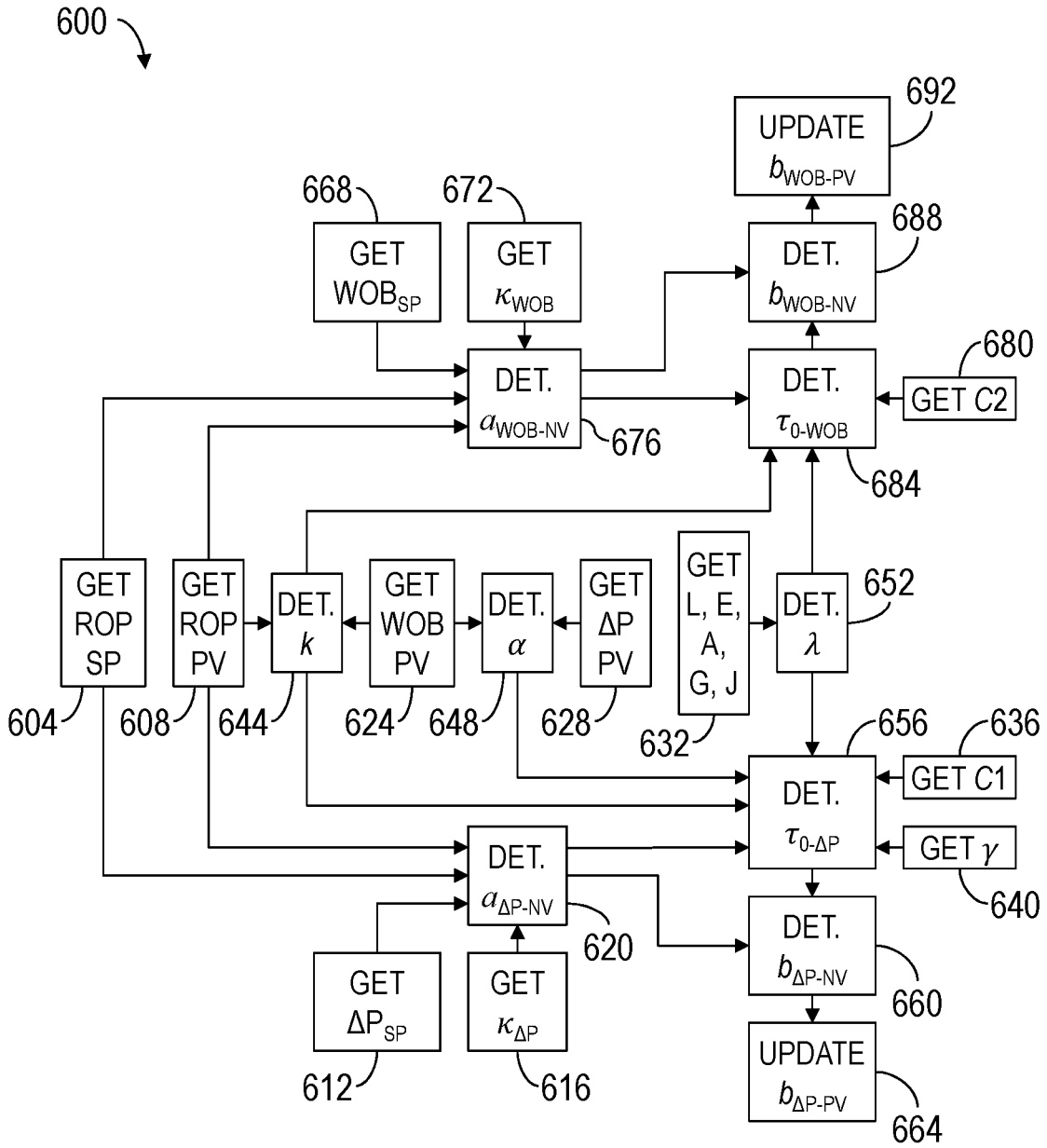
FIG. 6 is a flow-chart diagram of at least a portion of another example implementation of a method according to one or more aspects of the present disclosure.

FIG. 6 is a flow-chart diagram of at least a portion of another example implementation of a method 600 of real-time determination of the optimal time constant(s) described above. At least a portion of the method 600 may be performed by or otherwise in conjunction with one or more instances of apparatus depicted in one or both of FIGS. 2 and 3. Description below pertaining to obtain various parameters may be performed by or otherwise in conjunction with the sensors, HMIs, and/or other input and/or processing devices described above. For example, "getting" a drilling parameter or other parameter may comprise receiving, fetching, and/or otherwise obtaining data from one or more sensors, HMIs, and/or processing devices described above.

The method 600 may comprise getting 604 the current ROP setpoint, getting 608 the current ROP, getting 612 the current $\Delta P$ setpoint, and getting 616 the constant $\kappa_{\Delta P}$ to be utilized for the $\Delta P$-based control. These inputs are then utilized to determine 620 a new proportional gain $\alpha_{\Delta P\text{-}NV}$ to be utilized for the $\Delta P$-based control. Determining the new $\Delta P$-based control proportional gain $a_{\Delta P\text{-}NV}$ 620 may utilize Equation (49) set forth below.

$$a_{\Delta P-NV} = \kappa_{\Delta P}\frac{ROP_{PV} + \beta_{\Delta P}ROP_{SP}}{\Delta P_{SP}} \tag{49}$$

The method 600 may also comprise getting 624 the current WOB, getting 628 the current $\Delta P$, and getting 632 physical parameters of the drillstring (e.g., length L, cross-sectional area A, Young's modulus E, shear modulus G, polar moment of inertia J, etc.). The method 600 may also comprise getting 636 C1 (e.g., see Equation (38) set forth above), which may be determined after trial and error or other experience at the wellsite. The method 600 may also comprise getting 640 $\gamma$, such as may be determined by the fluid dynamics/compressibility of the system. The constant k that relates bit speed to WOB (e.g., a property of the bit, the rock, and the bit RPM) may then be determined 644 based on the current ROP 608 and the current WOB 624, such as via Equation (50) set forth below.

$$k = \frac{ROP_{PV}}{WOB_{PV}} \tag{50}$$

The constant $\alpha$ that relates the WOB 624 to the $\Delta P$ 628 may then be determined 648, such as via Equation (51) set forth below.

$$\alpha = \frac{\Delta P_{PV}}{WOB_{PV}} \tag{51}$$

The axial compliance of the drillstring may be determined 652 based on the drillstring physical parameters 632, such as via Equation (48) set forth above. The optimal time constant $\tau_{0\text{-}\Delta P}$ to be utilized for the P-based control may then be determined 656 based on the new proportional gain $a_{\Delta P\text{-}FV}$ 620, the constant C1 636, the compressibility $\gamma$ 640, the constant k 644, the constant $\alpha$ 648, and the axial compliance $\lambda$ 652. Determining the optimal time constant $\tau_{0\text{-}\Delta P}$ may utilize Equation (52) set forth below.

$$\tau_{0-\Delta P} = \frac{C1}{\left(\frac{1}{\gamma} + \frac{k}{\lambda}\right)\left(1 + \frac{k}{a\alpha}\right)} \tag{52}$$

The new value for the integral gain $b_{\Delta P\text{-}NV}$ to replace the current integral gain $b_{\Delta P\text{-}PV}$ utilized for the $\Delta P$-based control may then be determined 660 based on the new $\Delta P$-based control proportional gain $a_{\Delta P\text{-}NV}$ 620 and the $\Delta P$-based control time constant $\tau_{0\text{-}\Delta P}$ 656, such as via Equation (53) set forth below.

$$b_{\Delta P-NV} = \frac{a_{\Delta P-NV}}{\tau_{0-\Delta P}} \tag{53}$$

The current integral gain $b_{\Delta P\text{-}PV}$ may then be replaced or otherwise updated 664 with the new integral gain $b_{\Delta P\text{-}NV}$ 660.

The method 600 may also (or instead) be utilized for WOB-based control. For example, the method 600 may comprise getting 668 the current WOB setpoint and getting 672 the constant $\kappa$ to be utilized for the WOB-based control. A new proportional gain $a_{WOB\text{-}NV}$ to be utilized for the WOB-based control may then be determined 676 based on the current ROP 608, the ROP setpoint 604, the WOB setpoint 668, and the constant $\kappa$ 672. Determining the new WOB-based control proportional gain $a_{WOB\text{-}NV}$ 676 may utilize Equation (54) set forth below.

$$a_{WOB-NV} = \kappa_{WOB}\frac{ROP_{PV} + \beta_{WOB}ROP_{SP}}{WOB_{SP}} \tag{54}$$

The method 600 may also comprise getting 680 the constant C2 (e.g., see Equation (39) set forth above), which may be determined after trial and error or other experience at the wellsite. The optimal time constant $\tau_{0\text{-}WOB}$ to be utilized for the WOB-based control may then be determined 684 based on the constant k 644, the axial compliance 652, the new proportional gain $a_{WOB\text{-}NV}$ 676, and the constant C2 680. Determining the optimal time constant $\tau_{0\text{-}WOB}$ may utilize Equation (55) set forth below.

$$\tau_{0-WOB} = C2\frac{18}{5}\left(\frac{\lambda a_{WOB-NV}}{(a_{WOB-NV}+k)^2}\right) \tag{55}$$

A new value for the integral gain $b_{WOB\text{-}NV}$ to replace the current integral gain $b_{WOB\text{-}PV}$ utilized for the WOB-based control may then be determined 688 based on the new WOB-based control proportional gain $a_{WOB\text{-}NV}$ 676 and the WOB-based control time constant $\tau_{0\text{-}WOB}$ 684. The current integral gain $b_{WOB\text{-}PV}$ may then be replaced or otherwise updated 692 with the new integral gain $b_{WOB\text{-}NV}$ 688.

The proportional and/or integral gains currently used by the autodriller may be updated 664, 692 automatically with the new proportional gain $a_{\Delta P\text{-}NV}$ 620, the new proportional gain $a_{WOB\text{-}NV}$ 676, the new integral gain $b_{\Delta P\text{-}NV}$ 660, and/or the new integral gain $b_{WOB\text{-}NV}$ 688. The newly determined proportional gains $a_{\Delta P\text{-}NV}$, $a_{WOB\text{-}NV}$ and/or integral gains $b_{\Delta P\text{-}NV}$, $b_{WOB\text{-}NV}$ (and perhaps the current proportional gains $a_{\Delta P\text{-}PV}$, $a_{WOB\text{-}PV}$ and/or integral gains $b_{\Delta P\text{-}PV}$, $b_{WOB\text{-}PV}$) may be displayed (not depicted in FIG. 6, but similar to as depicted in FIGS. 4 and 5) to rig personnel, such as via one or more output devices 195 shown in FIG. 1, who may sometimes decide to perform the updates 664, 692.

As described above with reference to FIG. 4, the method 600 (or at least a portion thereof) may be performed on a predetermined and/or user-input schedule. Such schedule may be at regular time intervals (e.g., ten-minute intervals), or at action-based intervals (e.g., once per stand). The schedule may instead correspond to when a change in one or more drilling parameters (e.g., ROP, WOB, ΔP, surface pressure, top drive torque, proportional gain, integral gain, gain time constant, and/or others) is detected as being above a threshold amount. Other schedules are also within the scope of the present disclosure, including combinations of the above examples.

One or more aspects of the method 500 in FIG. 5 and/or the method 600 in FIG. 6 are similar or the same and may be combined to form other example implementations within the scope of the present disclosure. One or more aspects of the method 500 in FIG. 5 and/or the method 600 in FIG. 6 may also be similar to those that may be utilized for $T_{TD}$-based control within the scope of the present disclosure, whether alone or in combination with ΔP-based and/or WOB-based control. For example, in such implementations, the axial compliance λ may be determined according to Equations (56)-(58) set forth below.

$$\lambda = L/(G*J) \tag{56}$$

$$k = ROP_{PV}/T_{TD-PV} \tag{57}$$

$$a_{T_{TD}} = \kappa_{T_{TD}}\frac{ROP_{PV}+\beta_{T_{TD}}ROP_{SP}}{T_{TD_{SP}}} \tag{58}$$

where G is the shear modulus of the drillstring, J is the polar moment of inertia of the drillstring, $T_{TD\text{-}PV}$ is the current top drive torque $T_{TD}$, and $T_{TD_{SP}}$ is the current $T_{TD}$ setpoint.

In each of the example implementations described above, the data (e.g., data obtained via sensors) may be filtered and/or averaged values. For example, the measured WOB, ROP, ΔP (or surface pressure utilized to determine ΔP), and/or $T_{TD}$, among other data, may be low-pass filtered before utilization in the equations above, such as to remove noise in the sensor signals indicating instantaneous values.

In view of the entirety of the present disclosure, including the figures and the claims, a person having ordinary skill in the art will readily recognize that the present disclosure introduces a method comprising: determining a proportional gain and an integral gain each to be utilized by a PI controller of an autodriller controlling operation of equipment (e.g., top drive, drawworks, and/or mud pumps) to be utilized for a drilling operation to drill a borehole into a subterranean formation; commencing the drilling operation; and during the drilling operation, updating the integral gain in real-time utilizing current values of drilling parameters that change with respect to time.

The method may further comprise, during the drilling operation, updating the proportional gain in real-time utilizing the current values of at least one of the drilling parameters.

Determining the integral gain may utilize the determined proportional gain and comprises determining in real-time an optimal time constant. The PI controller of the autodriller may control operation of the equipment based on a pressure differential across a mud motor (e.g., as may be determined by surface pressure). The PI controller of the autodriller may also or instead control operation of the equipment based on WOB.

The updating may be performed on a predetermined and/or user-input schedule. The schedule may be at regular time intervals and/or action-based intervals. For example, the schedule may correspond to when a change above a threshold amount is detected.

The PI controller of the autodriller may control operation of the equipment via control of at least ΔP, determining the integral gain in real-time may comprise determining a ΔP integral gain, and determining the ΔP integral gain may comprise: determining a time constant based on ones of the current values of the drilling parameters, including the ΔP, the ROP, the WOB, physical parameters of the drillstring, and the proportional gain; and determining the ΔP integral gain based on the time constant and the proportional gain. Determining the proportional gain may comprise determining a ΔP proportional gain in real-time based on ones of the current values of the drilling parameters, including: the ROP, a setpoint of the ROP, and a setpoint of the ΔP. Determining the ΔP integral gain may be based on the time constant and the ΔP proportional gain.

The PI controller of the autodriller may control operation of the equipment via control of at least WOB, determining the integral gain in real-time may comprise determining a WOB integral gain, and determining the WOB integral gain may comprise: determining a time constant based on ones of the current values of the drilling parameters, including the WOB, the ROP, physical parameters of the drillstring, and the proportional gain; and determining the WOB integral gain based on the time constant and the proportional gain. Determining the proportional gain may comprise determining a WOB proportional gain in real-time based on ones of the current values of the drilling parameters, including the ROP, a setpoint of the ROP, and a setpoint of the WOB.

Determining the WOB integral gain may be based on the time constant and the WOB proportional gain.

The PI controller may control operation of the equipment via control of at least ΔP and WOB. In such implementations, among others within the scope of the present disclosure, determining the integral gain may comprise: determining in real-time a ΔP integral gain for use in control of the ΔP; and determining in real-time a WOB integral gain for use in control of the WOB. Determining the ΔP integral gain in real-time may comprise: determining a ΔP time constant based on ones of the current values of the drilling parameters, including the ΔP, the ROP, the WOB, physical parameters of a drillstring, and the proportional gain; and determining the ΔP integral gain based on the ΔP time constant and the proportional gain. Determining the WOB integral gain in real-time may comprise: determining a WOB time constant based on ones of the current values of the drilling parameters, including the WOB, the ROP, the physical parameters of the drillstring, and the proportional gain; and determining the WOB integral gain based on the WOB time constant and the proportional gain. Determining the proportional gain may comprise: determining in real-time a ΔP proportional gain for use in control of the ΔP; and determining in real-time a WOB proportional gain for use in control of the WOB. Determining the ΔP proportional gain in real-time may be based on ones of the current values of the drilling parameters, including the ROP, a setpoint of the ROP, and a setpoint of the ΔP. Determining the ΔP integral gain may be based on the ΔP time constant and the ΔP proportional gain. Determining the WOB proportional gain in real-time may be based on ones of the current values of the drilling parameters, including the ROP, the setpoint of the ROP, and a setpoint of the WOB. Determining the WOB integral gain may be based on the WOB time constant and the WOB proportional gain.

The present disclosure also introduces an apparatus comprising a processing system comprising a processor and a memory storing an executable computer program code that, when executed by the processor: determines a proportional gain and an integral gain each to be utilized by a PI controller of an autodriller controlling operation of equipment (e.g., top drive, drawworks, and/or mud pumps) to be utilized for a drilling operation to drill a borehole into a subterranean formation; and during the drilling operation, updates the integral gain in real-time utilizing current values of drilling parameters that change with respect to time.

During the drilling operation, the processing system may also update the proportional gain in real-time utilizing the current values of at least one of the drilling parameters.

Determining the integral gain may utilize the determined proportional gain and comprises determining in real-time an optimal time constant.

The PI controller of the autodriller may control operation of the equipment via control of at least ΔP, determining the integral gain in real-time may comprise determining a ΔP integral gain, and determining the ΔP integral gain may comprise: determining a time constant based on ones of the current values of the drilling parameters, including the ΔP, the ROP, the WOB, physical parameters of the drillstring, and the proportional gain; and determining the ΔP integral gain based on the time constant and the proportional gain. Determining the proportional gain may comprise determining a ΔP proportional gain in real-time based on ones of the current values of the drilling parameters, including the ROP, a setpoint of the ROP, and a setpoint of the ΔP. Determining the ΔP integral gain may be based on the time constant and the ΔP proportional gain.

The PI controller of the autodriller may control operation of the equipment via control of at least WOB, determining the integral gain in real-time may comprise determining a WOB integral gain, and determining the WOB integral gain may comprise: determining a time constant based on ones of the current values of the drilling parameters, including the WOB, the ROP, physical parameters of the drillstring, and the proportional gain; and determining the WOB integral gain based on the time constant and the proportional gain. Determining the proportional gain may comprise determining a WOB proportional gain in real-time based on ones of the current values of the drilling parameters, including the ROP, a setpoint of the ROP, and a setpoint of the WOB. Determining the WOB integral gain may be based on the time constant and the WOB proportional gain.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. A method comprising:

determining a proportional gain and an integral gain of a PI controller of an autodriller for controlling operation of equipment for drilling a borehole into a subterranean formation using a drill bit of a drillstring, wherein determining the integral gain utilizes the determined proportional gain and comprises determining in real-time an optimal time constant; and during utilization of the PI controller of the autodriller for controlling operation, updating the integral gain in real-time utilizing current values of drilling parameters that change with respect to time, wherein the autodriller controls operation by changing operation of one or more of a top drive, a drawworks, and a mud pump based on the updating of the integral gain.

2. The method of claim 1 wherein the updating of the integral gain is performed on a predetermined and/or user-input schedule.

3. The method of claim 2 wherein the schedule is at regular time intervals.

4. The method of claim 2 wherein the schedule is at action-based intervals.

5. The method of claim 2 wherein the schedule corresponds to when a change above a threshold amount is detected.

6. The method of claim 1 wherein the PI controller of the autodriller controls operation via control of at least a pressure differential (ΔP) across a mud motor that is operable to rotate the drill bit, wherein determining the integral gain comprises determining a ΔP integral gain, and wherein determining the ΔP integral gain comprises:

determining the optimal time constant based on ones of the current values of the drilling parameters, including:

the ΔP;

a rate of penetration (ROP) of the drill bit into the formation;

a weight applied on the drill bit (WOB);

physical parameters of the drillstring; and the proportional gain; and determining the ΔP integral gain based on the optimal time constant and the proportional gain.

7. The method of claim 6 wherein:

determining the proportional gain comprises determining a ΔP proportional gain in real-time based on ones of the current values of the drilling parameters, including:

the ROP;

a setpoint of the ROP; and a setpoint of the ΔP; and determining the ΔP integral gain is based on the optimal time constant and the ΔP proportional gain.

8. The method of claim 1 wherein the PI controller of the autodriller controls operation via control of at least a weight applied on the drill bit (WOB), wherein determining the integral gain comprises determining a WOB integral gain, and wherein determining the WOB integral gain comprises:

determining the optimal time constant based on ones of the current values of the drilling parameters, including:

the WOB;

a rate of penetration (ROP) of the drill bit into the formation;

physical parameters of the drillstring; and the proportional gain; and determining the WOB integral gain based on the optimal time constant and the proportional gain.

9. The method of claim 8 wherein:

determining the proportional gain comprises determining a WOB proportional gain in real-time based on ones of the current values of the drilling parameters, including:

the ROP;

a setpoint of the ROP; and a setpoint of the WOB; and determining the WOB integral gain is based on the optimal time constant and the WOB proportional gain.

10. The method of claim 1 wherein:

the PI controller of the autodriller controls operation via control of at least:

a pressure differential (ΔP) across a mud motor that is operable to rotate the drill bit utilized; and a weight applied on the drill bit (WOB);

determining the integral gain comprises:

determining in real-time a ΔP integral gain for use in control of the ΔP; and determining in real-time a WOB integral gain for use in control of the WOB;

determining the ΔP integral gain in real-time comprises:

determining a ΔP time constant based on ones of the current values of the drilling parameters, including:

the ΔP;

a rate of penetration (ROP) of the drill bit into the formation;

the WOB;

physical parameters of the drillstring; and the proportional gain; and determining the ΔP integral gain based on the ΔP time constant and the proportional gain; and determining the WOB integral gain in real-time comprises:

determining a WOB time constant based on ones of the current values of the drilling parameters, including:

the WOB;

the ROP;

the physical parameters of the drillstring; and the proportional gain; and determining the WOB integral gain based on the WOB time constant and the proportional gain.

11. The method of claim 10 wherein:

determining the proportional gain comprises:

determining in real-time a ΔP proportional gain for use in control of the ΔP; and determining in real-time a WOB proportional gain for use in control of the WOB;

determining the ΔP proportional gain in real-time is based on ones of the current values of the drilling parameters, including:

the ROP;

a setpoint of the ROP; and a setpoint of the ΔP; and determining the ΔP integral gain is based on the AP time constant and the AP proportional gain;

determining the WOB proportional gain in real-time is based on ones of the current values of the drilling parameters, including:

the ROP;

the setpoint of the ROP; and a setpoint of the WOB; and determining the WOB integral gain is based on the WOB time constant and the WOB proportional gain.

12. The method of claim 1 wherein the determining the optimal time constant comprises utilizing a condition for stability that depends at least in part on fluid pressure.

13. The method of claim 1, comprising contextual scaling of the proportional gain by a function of average rate of penetration (ROP) and an ROP setpoint divided by a selected controlling parameter setpoint, wherein the integral gain is determined based on a quotient of the proportional gain and the optimal time constant, wherein the optimal time constant is determined based on a determined drilling context.

14. An apparatus comprising:

a processing system comprising a processor and a memory storing an executable computer program code that, when executed by the processor:

determines a proportional gain and an integral gain of a PI controller of an autodriller for controlling operation of equipment for drilling a borehole into a subterranean formation using a drill bit of a drillstring, wherein determining the integral gain utilizes the determined proportional gain and comprises determining in real-time an optimal time constant; and during utilization of the PI controller of the autodriller for controlling operation, updates the integral gain in real-time utilizing current values of drilling parameters that change with respect to time, wherein the autodriller controls operation by changing operation of one or more of a top drive, a drawworks, and a mud pump based on the updating of the integral gain.

15. The apparatus of claim 14 wherein, the processing system updates the proportional gain in real-time utilizing the current values of at least one of the drilling parameters.

16. The apparatus of claim 14 wherein the PI controller of the autodriller controls operation via control of at least a pressure differential (ΔP) across a mud motor that is operable to rotate the drill bit, wherein determining the integral gain comprises determining a ΔP integral gain, and wherein determining the ΔP integral gain comprises:

determining the optimal time constant based on ones of the current values of the drilling parameters, including:
the ΔP;
a rate of penetration (ROP) of the drill bit into the formation;
a weight applied on the drill bit (WOB);
physical parameters of the drillstring; and
the proportional gain; and determining the ΔP integral gain based on the optimal time constant and the proportional gain.

17. The apparatus of claim 16 wherein:

determining the proportional gain comprises determining a ΔP proportional gain in real-time based on ones of the current values of the drilling parameters, including:
the ROP;
a setpoint of the ROP; and
a setpoint of the ΔP; and determining the ΔP integral gain is based on the optimal time constant and the ΔP proportional gain.

18. The apparatus of claim 14 wherein the PI controller of the autodriller controls operation via control of at least a weight applied on the drill bit (WOB), wherein determining the integral gain in real-time comprises determining a WOB integral gain, and wherein determining the WOB integral gain comprises:

determining the optimal time constant based on ones of the current values of the drilling parameters, including:
the WOB;
a rate of penetration (ROP) of the drill bit into the formation;
physical parameters of the drillstring; and
the proportional gain; and determining the WOB integral gain based on the optimal time constant and the proportional gain.

19. The apparatus of claim 18 wherein:

determining the proportional gain comprises determining a WOB proportional gain in real-time based on ones of the current values of the drilling parameters, including:
the ROP;
a setpoint of the ROP; and
a setpoint of the WOB; and
determining the WOB integral gain is based on the optimal time constant and the WOB proportional gain.

* * * * *